US009103580B2

(12) United States Patent
Bryson et al.

(10) Patent No.: US 9,103,580 B2
(45) Date of Patent: Aug. 11, 2015

(54) DISPLAY TRAY SYSTEM

(71) Applicant: Process Retail Group, Inc., New Berlin, WI (US)

(72) Inventors: M. Scott Bryson, Brookfield, WI (US); Terry Berglund, Hales Corners, WI (US); Dowie Soetenga, Waukesha, WI (US)

(73) Assignee: Process Retail Group, Inc., New Berlin, WI (US)

( * ) Notice: Subject to any disclaimer, the term of this patent is extended or adjusted under 35 U.S.C. 154(b) by 202 days.

(21) Appl. No.: 13/833,163

(22) Filed: Mar. 15, 2013

(65) Prior Publication Data

US 2013/0200026 A1 Aug. 8, 2013

Related U.S. Application Data

(63) Continuation-in-part of application No. 13/441,147, filed on Apr. 6, 2012, now Pat. No. 8,967,393.

(60) Provisional application No. 61/472,458, filed on Apr. 6, 2011.

(51) Int. Cl.

| | |
|---|---|
| ***A47F 1/04*** | (2006.01) |
| ***F25D 25/02*** | (2006.01) |
| ***A47F 1/12*** | (2006.01) |
| ***A47F 5/10*** | (2006.01) |

(52) U.S. Cl.

CPC ..... *F25D 25/021* (2013.01); *A47F 1/126* (2013.01); *A47F 5/10* (2013.01); *F25D 2325/021* (2013.01)

(58) Field of Classification Search

CPC ..... A47F 1/126; A47F 5/10; F25D 2325/021; F25D 25/021

USPC ..... 211/59.2, 59.3, 59.4, 184; 108/102, 108/137, 152

See application file for complete search history.

(56) References Cited

U.S. PATENT DOCUMENTS

| | | | |
|---|---|---|---|
| 905,737 | A | 12/1908 | McCombe |
| 1,257,843 | A | 2/1918 | Gonyea |
| 2,623,641 | A | 12/1952 | Shield |
| 3,061,969 | A | 11/1962 | Lee |
| 3,447,491 | A | 6/1969 | Noren |
| 3,511,192 | A | 5/1970 | Noren |
| 4,830,201 | A | 5/1989 | Breslow |
| 4,901,869 | A | 2/1990 | Hawkinson et al. |
| 5,022,535 | A | 6/1991 | Spamer |
| 5,199,584 | A | 4/1993 | Fowler et al. |
| 5,255,802 | A | 10/1993 | Krinke et al. |
| 5,450,968 | A | 9/1995 | Bustos |

(Continued)

OTHER PUBLICATIONS

Office Action mailed on Dec. 17, 2013 in parent U.S. Appl. No. 13/441,147.

(Continued)

*Primary Examiner* — Korie H Chan

(57) ABSTRACT

A display tray system includes a union tray section having a center wall and first and second trays extending away from the center wall. A first center tray assembly includes a first center tray section secured to a first base and defining a first gap therebetween. The first tray is movably secured within the first gap. A second center tray assembly includes a second center tray section secured to a second base and defines a second gap therebetween. The second tray is movably secured within the second gap.

17 Claims, 19 Drawing Sheets

(56) References Cited

U.S. PATENT DOCUMENTS

| | | | |
|---|---|---|---|
| 5,553,824 | A | 9/1996 | Dutra, Jr. |
| 5,740,926 | A | 4/1998 | Mulloy |
| 6,227,385 | B1 | 5/2001 | Nickerson |
| 6,276,538 | B1 | 8/2001 | Battaglia et al. |
| 6,311,852 | B1 | 11/2001 | Ireland |
| 6,401,942 | B1 | 6/2002 | Eckert |
| 6,409,028 | B2 | 6/2002 | Nickerson |
| 6,513,667 | B2 | 2/2003 | Battaglia et al. |
| 6,533,131 | B2 | 3/2003 | Bada |
| 6,886,699 | B2 | 5/2005 | Johnson et al. |
| 7,028,852 | B2 | 4/2006 | Johnson et al. |
| 7,124,898 | B2 | 10/2006 | Richter et al. |
| 8,016,139 | B2 | 9/2011 | Hanners et al. |
| 8,235,226 | B2 | 8/2012 | Crawbuck et al. |
| 2003/0085187 | A1 | 5/2003 | Johnson et al. |
| 2003/0132178 | A1 | 7/2003 | Jay et al. |
| 2010/0032391 | A1 | 2/2010 | Schneider et al. |

OTHER PUBLICATIONS

Office Action mailed on Jul. 1, 2014 in parent U.S. Appl. No. 13/441,147.

DISPLAY TRAY SYSTEM

CROSS REFERENCE TO RELATED APPLICATION

This application is a continuation-in-art of U.S. patent application Ser. No. 13/441,147, filed on Apr. 6, 2012, which claims priority to U.S. Provisional Application No. 61/472,458, filed Apr. 6, 2011, the contents of which are incorporated herein by reference in their entireties.

FIELD

The present application is directed to a display tray system. More specifically, the present application is directed to a freezer tray system for use in the display of products in a retail environment.

BACKGROUND

Current shelving systems, specifically freezer shelving systems, are designed to accommodate one or only a few varying product offering and/or shelf sizes. Universal shelving systems having a base and adjustable side walls for use with product packaging of any size and dimension, are not currently available. Such current systems also do not offer such functionality with a pusher having a forward bias for keeping product faced to the front of the shelf.

SUMMARY

An exemplary embodiment of a display tray system includes a union tray section with a center wall and first and second trays extending away from the center wall. A first center tray assembly includes a first center tray section secured to a first base and defining, a first gap therebetween. The first tray is movably secured within the first gap. A first product support area is defined by at least the first center tray section and the first tray. A second center tray assembly includes a second center tray section secured to a second base and defining a second gap therebetween. The second tray is movably secured within the second gap. A second product support area is defined by at least the second center tray section and the second tray.

An exemplary embodiment of a display tray system includes first, second, and third center tray assemblies. Each center tray assembly includes a center tray section, a plurality of ridges on a top surface of the center tray section, and a base secured to a bottom side of the center tray section defining a gap between the center tray section and the base. A side tray section includes a side wall secured to a side tray. The side tray is movably received and secured within the gap of the first center tray assembly. A first union tray section includes a first center wall secured to first and second trays. The first tray is movably received and secured within the gap of the first tray assembly. The second tray is movably received and secured within the gap of the second center tray assembly. A second union tray section includes a second center wall secured to third and fourth trays. The third tray is movably received and secured within the gap of the second center tray assembly. The fourth tray is movably received and secured within the gap of the third center tray assembly. A first product support area is defined between the side wall, first center tray assembly, and the first center wall. A second product support area is defined between the first center wall, second center tray assembly, and the second center wall. A third product support area is defined between at least the second center wall and the third center tray assembly.

BRIEF DESCRIPTION OF THE DRAWINGS

FIG. 5*a* is a top plan view of an embodiment of a side tray section incorporated in the display tray assembly of FIG. 2;

DETAILED DESCRIPTION

In the present description, certain terms have been used for brevity, clearness and understanding. No unnecessary limitations are to be applied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

Figure 1:
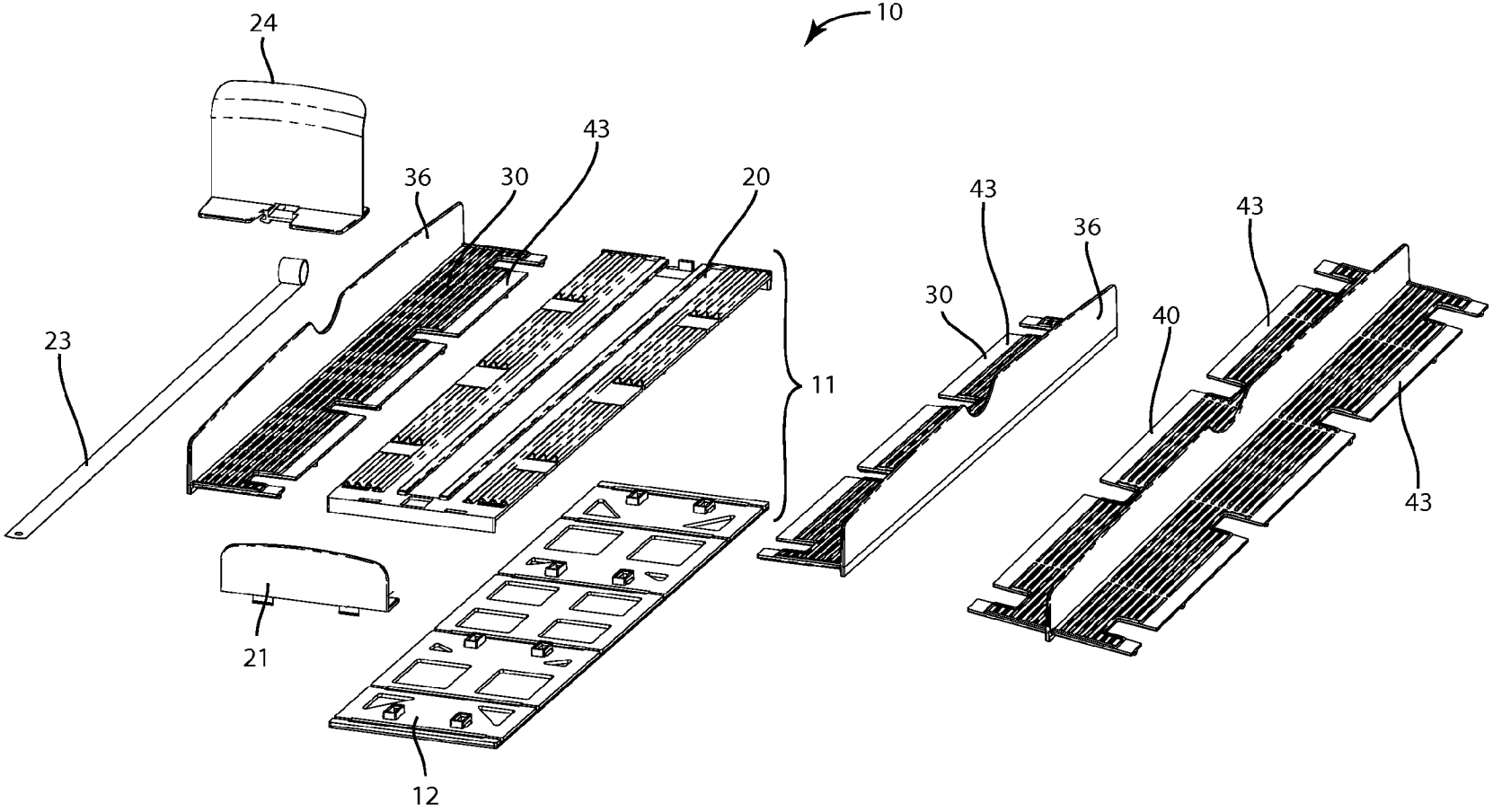
FIG. 1 is a front exploded isometric view of an embodiment of a display tray assembly in accordance with the present invention.

FIG. 1 illustrates one embodiment of a display tray assembly 10. Embodiments of the display tray assembly 10 as disclosed in further herein can be used in a variety of settings including the display of retail products. For the purposes of description, embodiments of the display tray assembly 10 that are adapted for use in a freezer will be described in detail herein; however, this is not intended to be limiting on the scope of display tray assemblies as disclosed herein. Generally, the display tray assembly 10 comprises a center tray section 20 and two side tray sections 30 that are movable with respect to the center tray section 20. Thus, the width of the freezer tray assembly 10 may be increased or decreased depending on certain conditions, e.g., the type of item to be stored on the freezer tray assembly 10 or the size of the freezer in which the freezer tray assembly 10 is mounted.

Figure 2:
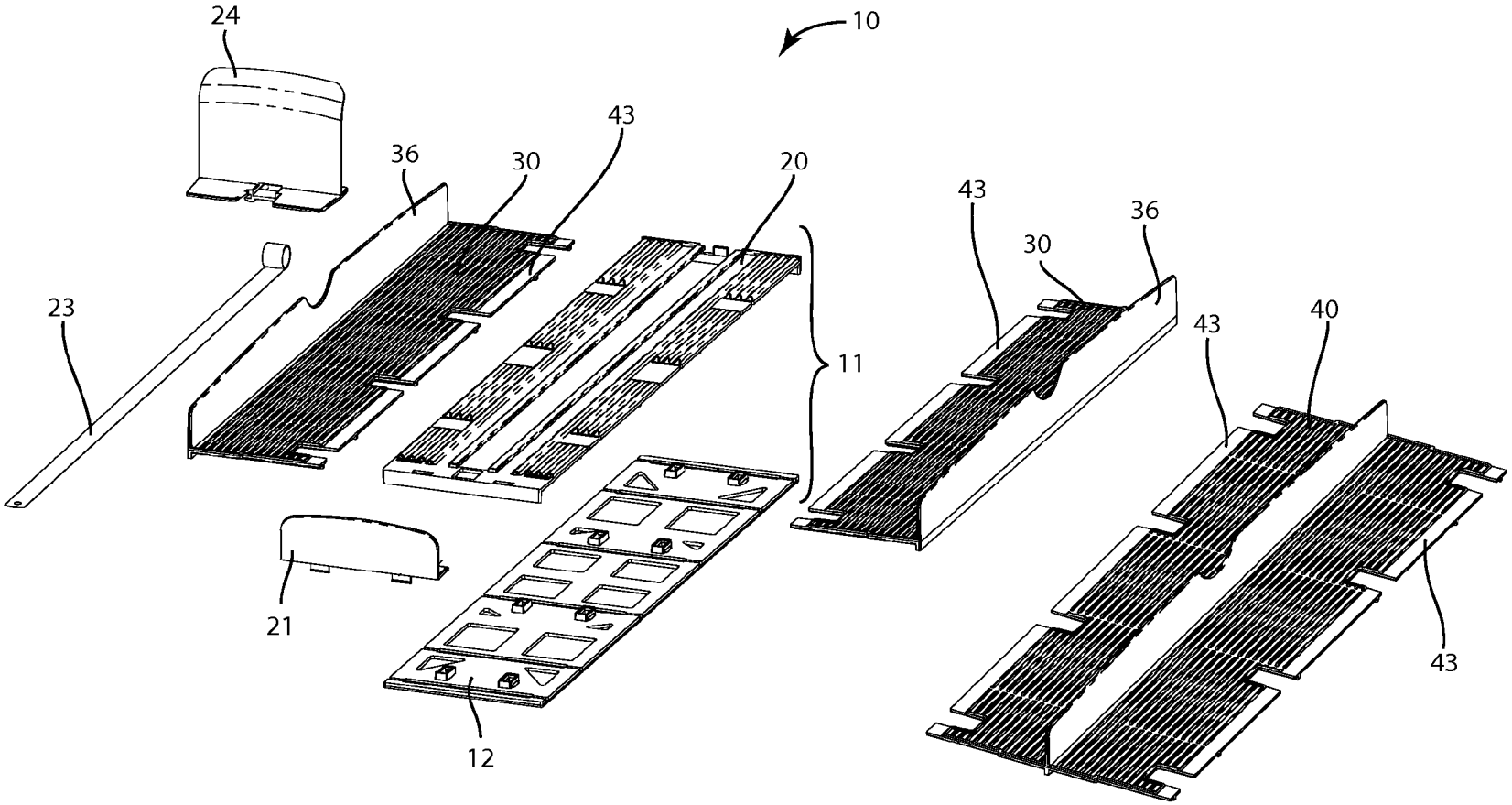
FIG. 2 is a front exploded isometric view of an embodiment of a display tray assembly in accordance with the present invention.
Figure 3A:
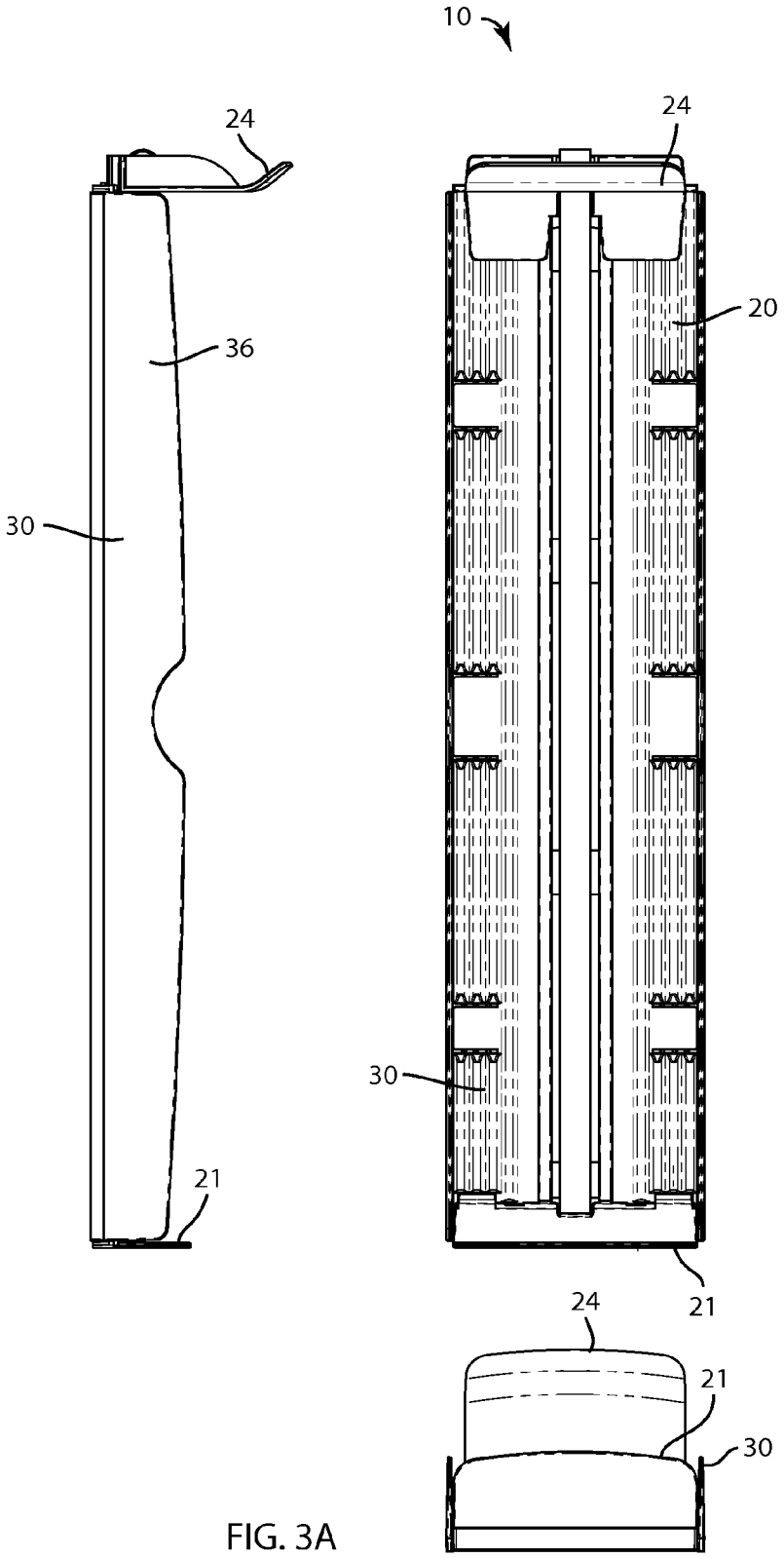
FIG. 3*a* is a top plan view of the display tray assembly of FIG. 1 in the retracted position.
Figure 3B:
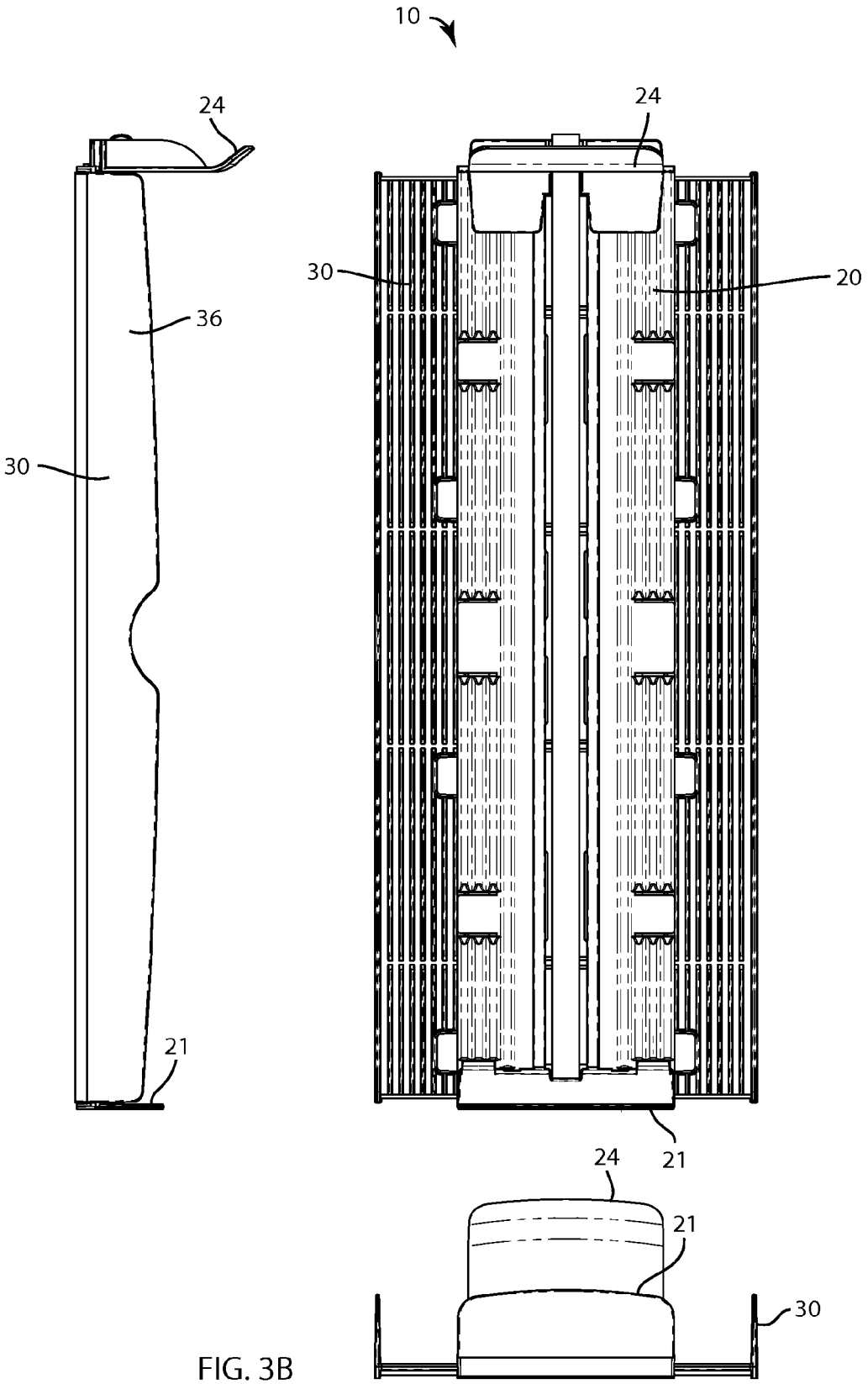
FIG. 3*b* is a top plan view of the display tray assembly of FIG. 1 in the expanded position.
Figure 4A:
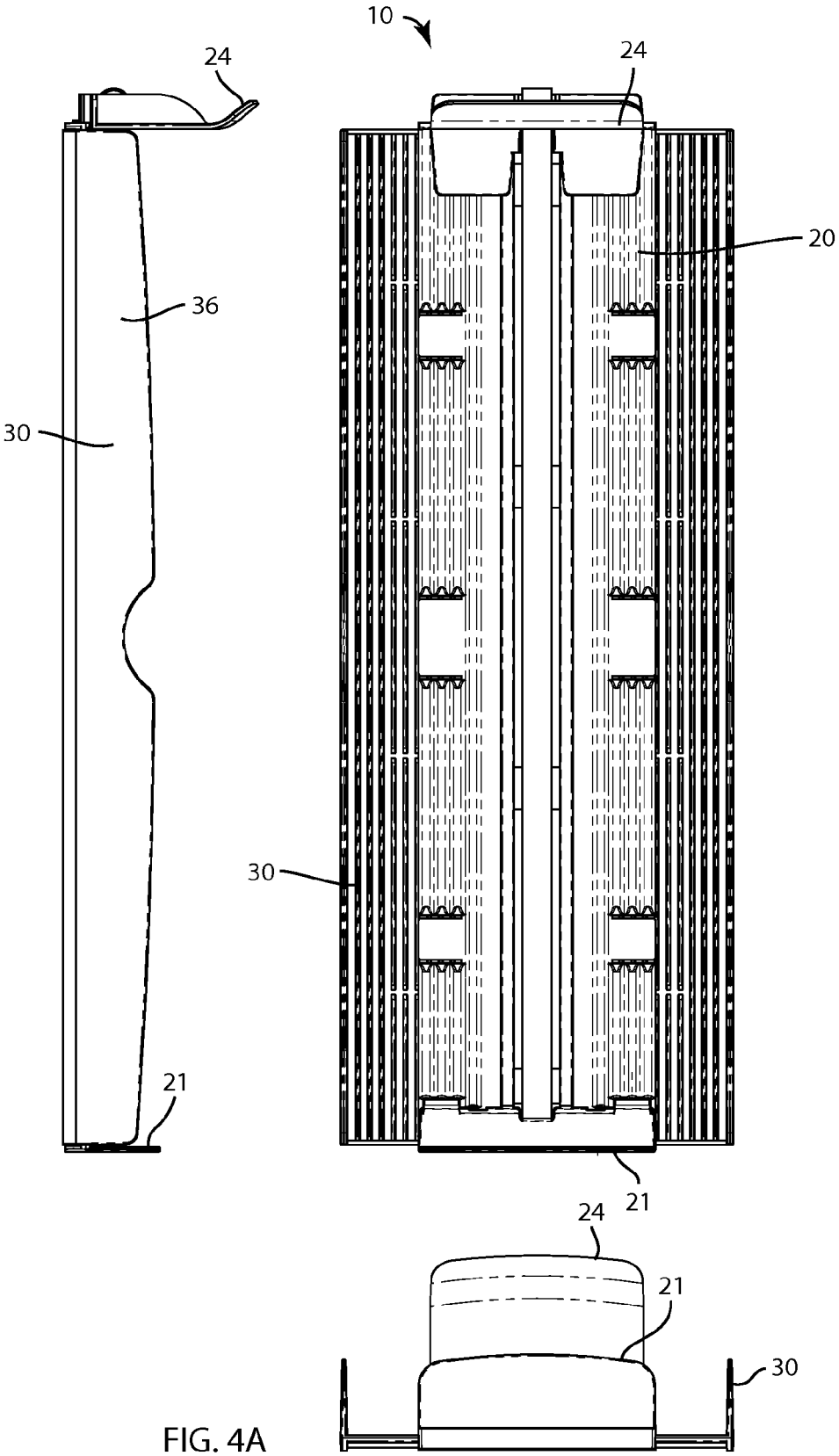
FIG. 4*a* is a top plan view of the display tray assembly of FIG. 2 in the retracted position.
Figure 4B:
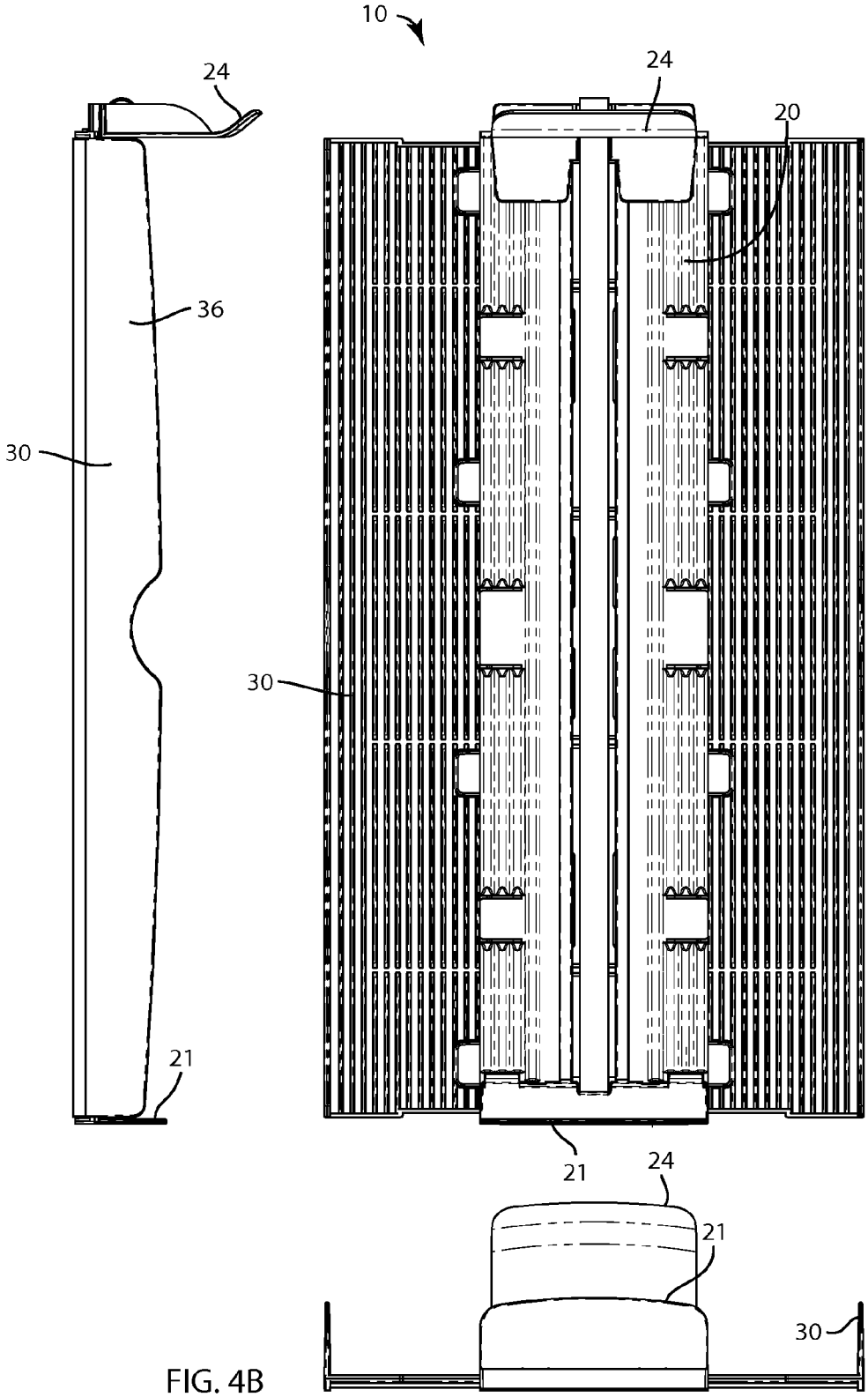
FIG. 4*b* is a top plan view of the display tray assembly of FIG. 2 in the expanded position.

Referring now to FIG. 2, an additional embodiment of the present application includes side tray sections 30 and a union tray section 40 that has a greater width than the embodiment illustrated in FIG. 1. It should be further noted that the embodiments shown in both FIG. 1 and FIG. 2 are exemplary only, and should not limit the claims to side tray sections 30 and union tray section 40 having the widths illustrated in FIGS. 1 and 2. Likewise, FIGS. 3*a* and 3*b* correspond with the embodiment of FIG. 1, and FIGS. 4*a* and 4*b* correspond with the embodiment illustrated in FIG. 2. FIGS. 3*a* and 4*a* illustrate the display tray assembly 10 of each embodiment in a minimum width configuration, or retracted position, while FIGS. 3*b* and 4*b* illustrate the embodiments of the display tray assembly 10 in a maximum width configuration, or extended position. All the sets of figures, FIGS. 3*a, b* and FIGS. 4*a, b*, illustrate exemplary embodiments of the display tray assembly shown in a position that defines the minimum and maximum width of its respective display tray assembly 10, and should not be construed to limit the display tray assemblies 10 to these widths.

Figure 5:
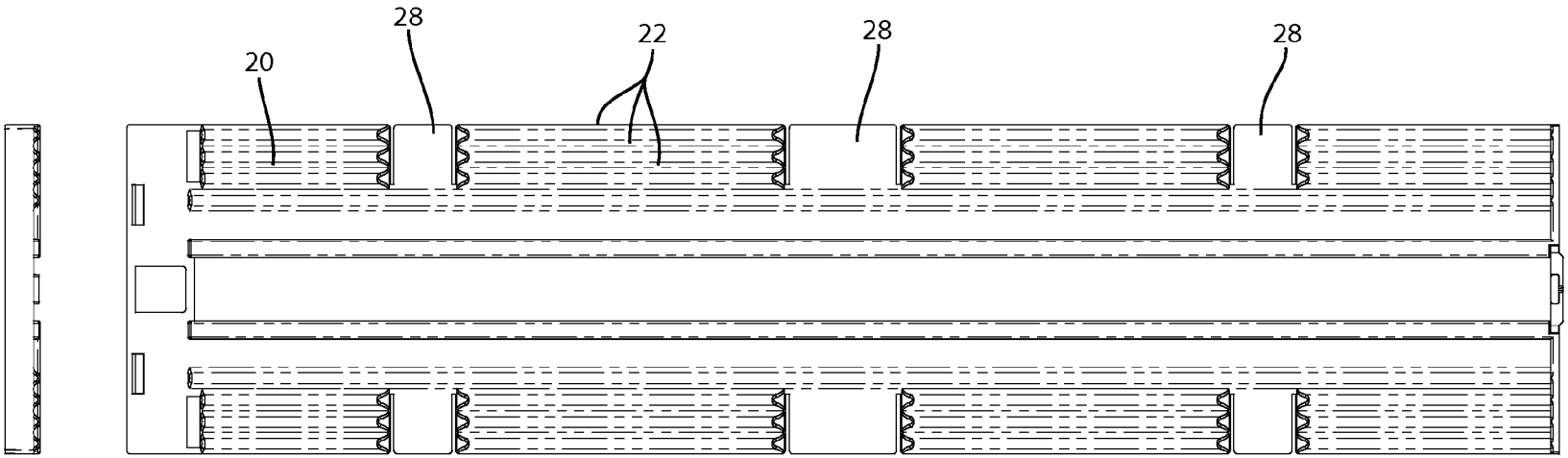
FIG. 5 is a top view of a center tray section incorporated in the display tray assembly of FIGS. 1 and 2.
Figure 6:
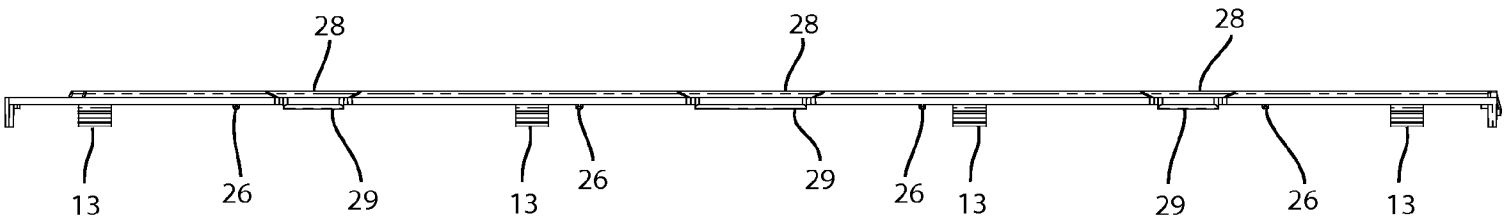
FIG. 6 is a side elevation view of the center tray section of FIG. 5.

As shown in FIGS. 5 and 6, the center tray section 20 may be in the form of a rectangular plate. The center tray section 20 preferably provides a solid floor for the freezer tray assembly 10 in that the surface of the center tray section 20 is substantially free of openings, as opposed to prior an freezer display assemblies that have open areas (such as is the case with mesh-type configurations that feature a number of open areas). A solid floor configuration provides support for less rigid items e.g., bags of frozen vegetables or potato products, in sliding along the freezer tray assembly 10 as the forward items are removed from the freezer tray assembly 10 by consumers. It is also contemplated, however, that the floor of center section 20 may be provided with slots or holes that are sized and configured so as not to catch the items as they are moved forwardly on the freezer try assembly 10. The slots or holes in the floor of center section 20 are designated to accommodate the flow of air within the freezer while providing unobstructed movement of the frozen items on freezer tray assembly 10.

Still referring to FIGS. 5 and 6, the center tray section 20 has a number of raised, axial ridges 22 that support items placed on the center tray section 20. The ridges 22 are substantially parallel to one another and run along a longitudinal axis of the center tray section 20. The ridges 22 are preferably equidistantly spaced from one another. The ridges 22 are preferably rounded, i.e., each ridge 22 has a radiused top surface. However, an suitable shape may be used for the ridges 22, so long as the ridges 22 are able to support the items on freezer tray assembly 10 and facilitate (and do not hinder) the sliding of the items along the freezer tray assembly 10. Alternatively, some embodiments of the center tray section 20 may have no ridges 22 at all.

Figure 12:
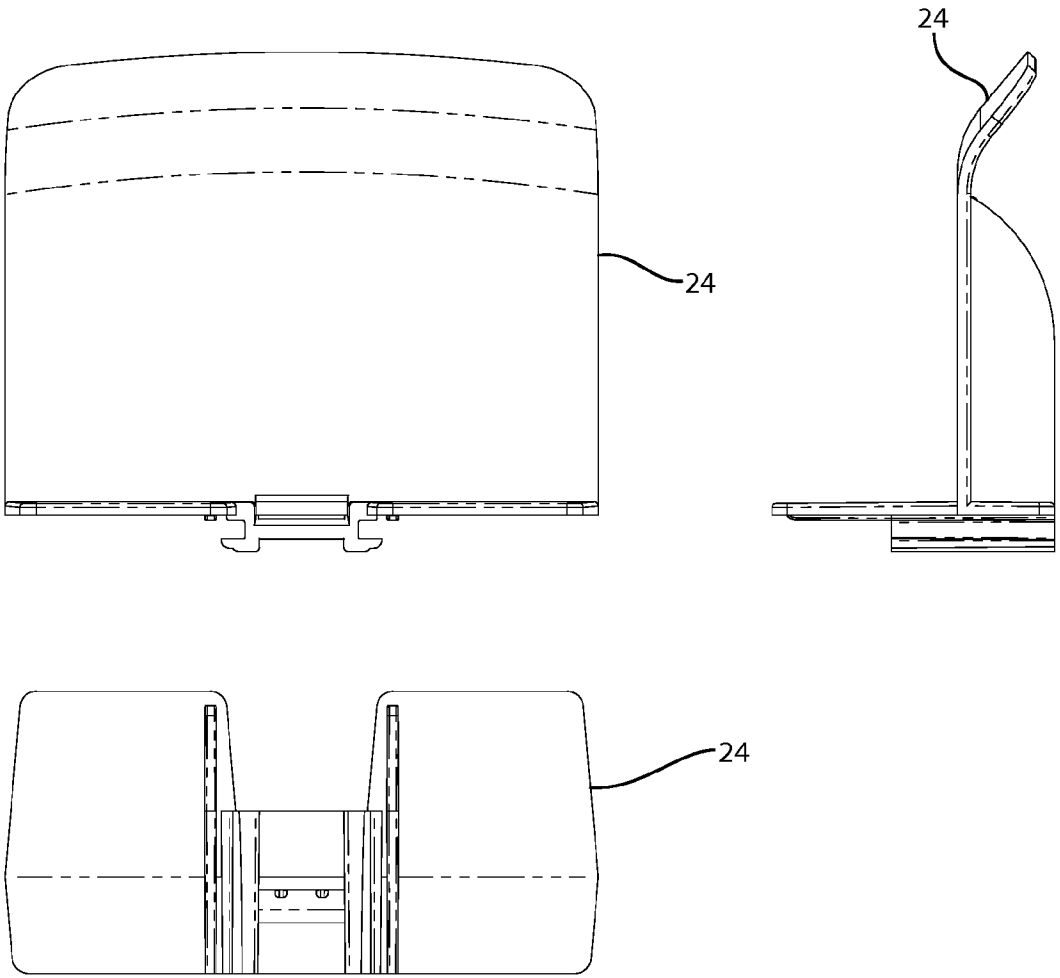
FIG. 12 is an isometric view of a pusher incorporated in the display tray assembly of FIGS. 1 and 2.

In the illustrated embodiment of FIGS. 5 and 6, the ridges 22 are separated into two groups on either side of the center tray section 20. The space defined between the two groups of ridges 22 accommodates a pusher 24 and bias element 23, e.g., a coil spring, that secures items on the freezer tray assembly 10 and also pushes the items supported on the center tray section 20 to the front of the freezer tray assembly 10 (i.e., the end of the tray proximate the freezer door) as other items are removed by consumers. The freezer tray assembly is stocked by a retail employee by overcoming the force applied by the pusher 24 to insert new product into the freezer tray assembly. The pusher 24 and bias element 23 are further illustrated in FIGS. 12 and 13.

Figure 15:
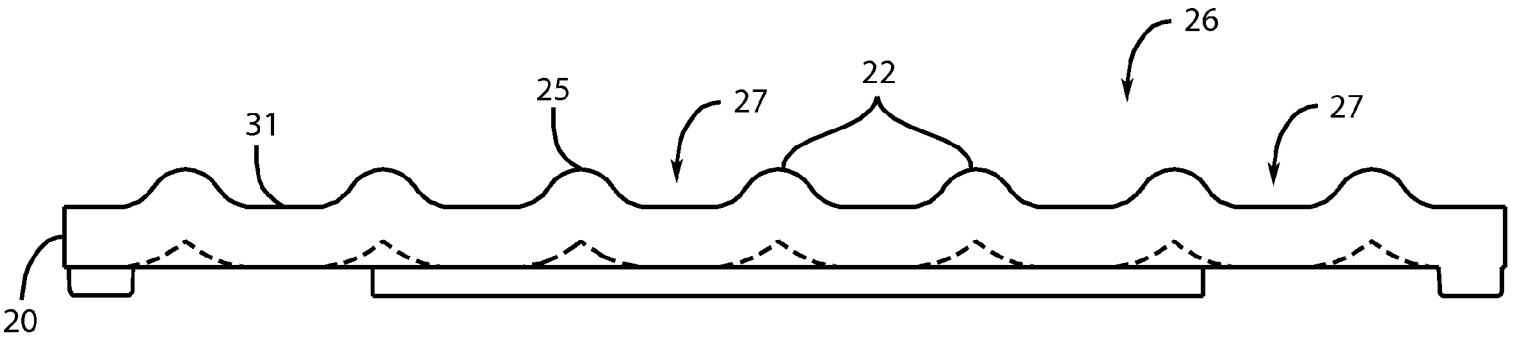
FIG. 15 is a cut away view of an exemplary embodiment of the center tray section.

FIG. 15 is a cutaway view of an exemplary embodiment of a center tray section 20. As shown in FIG. 15, the top surface 19 of the center tray section 20 comprises a plurality of ridges 22 that have a wave-like configuration that defines the ribs 22. Each rib 22 has a convex shape that defines a peak 25, i.e., the highest part of the rib 22, which contacts the bottom surface of a container resting on the ribs 22. Between the ribs 22 are valleys 27. The valleys 27 merge with the sides of the ribs 22, and have a concave shape. In the illustrated embodiment, the center tray section 20 has a plurality of ribs 22 that support the container or package, and valleys 27 between the ribs 22. Any number of ribs 22 and valleys 27 may be used as desired, in order to provide the optimal balance between a desired low degree of friction as provided by the disclosed center tray section 20 design and the weight and pressure of the container or package.

In one exemplary embodiment, the ribs 22 are spaced apart by a distance as measured between the peak 25 of two adjacent ribs 22) of between about 2% and about 6% of the width of the center tray section 20. In one embodiment, the ribs 22 are spaced apart by a distance of about 4% of the width of the center tray section 20. In still further non-limiting embodiments, the ribs 22 are spaced apart by a distance of between about 10% and 20% of the width of the center tray section 20. It is understood, however, that the ratio of the width between the ribs 22 and the width of the center tray section 20 may vary according to the parameters of the containers or packages, including weight, bottom footprint, configuration of the portion of the container or package that rests on the ribs, etc. The ribs 22 are spaced so as to minimize the number of contact points with the container, which minimizes friction and facilitates sliding of containers along the plurality of ribs 22. In addition, the spacing between the ribs 22 makes it easy to clean the top surface 19 of the center tray section 20. Specifically, the concave configuration of the valleys 27 and the convex configuration of the ribs 22 provide a smooth cross-section, without sharp corners or crevices, within which contaminants can be trapped. This feature provides for easy cleaning of embodiments of the freezer tray assembly 10.

In the illustrated embodiment, the height of the ribs 22 is between about 0.01 inch and about 0.1 inch, and more preferably, about 0.06 inch although the height of the ribs may vary for different containers or packages. The distance between the ribs 22 is between about 0.2 inch and about 0.5 inch, and more preferably, about 0.3 inch although again the spacing of ribs 22 may vary for different containers or packages. In an embodiment, the convex top of each rib 22 is preferably rounded, having a radius of curvature between about 0.05 inch and about 0.125 inch, which in a further embodiment is about 0.06 inch. The concave rounded side walls of the ribs 22 exemplarily have a radius of curvature between 0.05 inch and about 0.2 inch, and in one non-limiting embodiment, about 0.125 inch. As further depicted in FIG. 15, in an embodiment of the center tray section 20 the bottom of each valley 27 has a portion 31 that is substantially flat. This substantially flat portion 31, in an embodiment, has a width of between about 0.5 inch and about 0.15 inch, in a further embodiment, the substantially flat portion 31 is about 0.1 inch. In a still further non-limiting embodiment, the substantially flat portion 31 is between about 0.03 inch and about 0.09 inch.

As disclosed above, and in further detail herein, the plurality of ribs 22 minimizes the surface area that is in contact with a bottom surface of a container supported by the plurality of ribs 22. In particular, the radiused peak of each rib 22 provides point-type contact that significantly reduces contact surface area, while not digging into or otherwise damaging the material of the container, and without the package or container digging into, or otherwise damaging the material of the ribs 22 themselves, as could occur with ribs that have a more pointed construction. The radiused peak of each rib 22 functions to deflect or route pressure or stress on the rib 22 from the package or container radially downwardly to the valleys 27, much in the same manner as is accomplished by a Roman arch design. This cross-sectional configuration of the ribs 22 functions to dissipate the force and pressure from the container or package into the valleys 27, and decreases pressure and rib deformation or creep from the weight of the container or package, which greatly enhances the ability of the containers or packages to move along the ribs when a force is applied. Creep is undesirable because it presents increased friction between a container and its supporting surface and thereby can inhibit the sliding movement of the containers along a shelf or other support structure. By eliminating creep, as mentioned above, the center tray section 20 as disclosed reduces the force required to translate containers or packages along the center tray section 20.

At least the top surface 19 of the center tray section 20 as disclosed herein may be formed of a low friction material, which further facilitates the forward sliding movement of containers along the plurality of ribs 22. Exemplarily, the top surface 19 of the center tray section 20 may be formed of a Teflon material such as a DuPont Teflon® grade 7B granular compression molding resin or an ABS plastic material incorporating a low friction agent, although it is understood that any other satisfactory low friction material may be employed. The center tray section 20 may be over-molded, coated, sprayed, or simply made of low friction material. Alternatively, the center tray section 20 may be made of a material that includes a low friction additive such, but not limited to, Teflon.

This disclosed embodiment of the center tray section 20 is, in embodiments, dimensioned particularly for the types of containers or packages with which the freezer tray assembly 10 will be used. This design provides optimal operation by including any number of ribs 22 greater than two to be in contact with the bottom of the container or package, according to container variables including, container type (flexible or rigid), weight, surface area, material, and finish.

Embodiments of the center tray section 20 as disclosed herein provide additional advantages for use in retail merchandising applications. The plurality of ribs 22 are easy to clean by virtue of the ungulate wave-like concave-convex configuration of valleys 27 and ribs 22, without the presence of sharply angled corners, cracks or crevices within which dirt, spillage, or bacteria tend to be trapped. The design of embodiments provide a superior low drag surface that provides further advantages as will be described in further detail herein.

Figure 14:
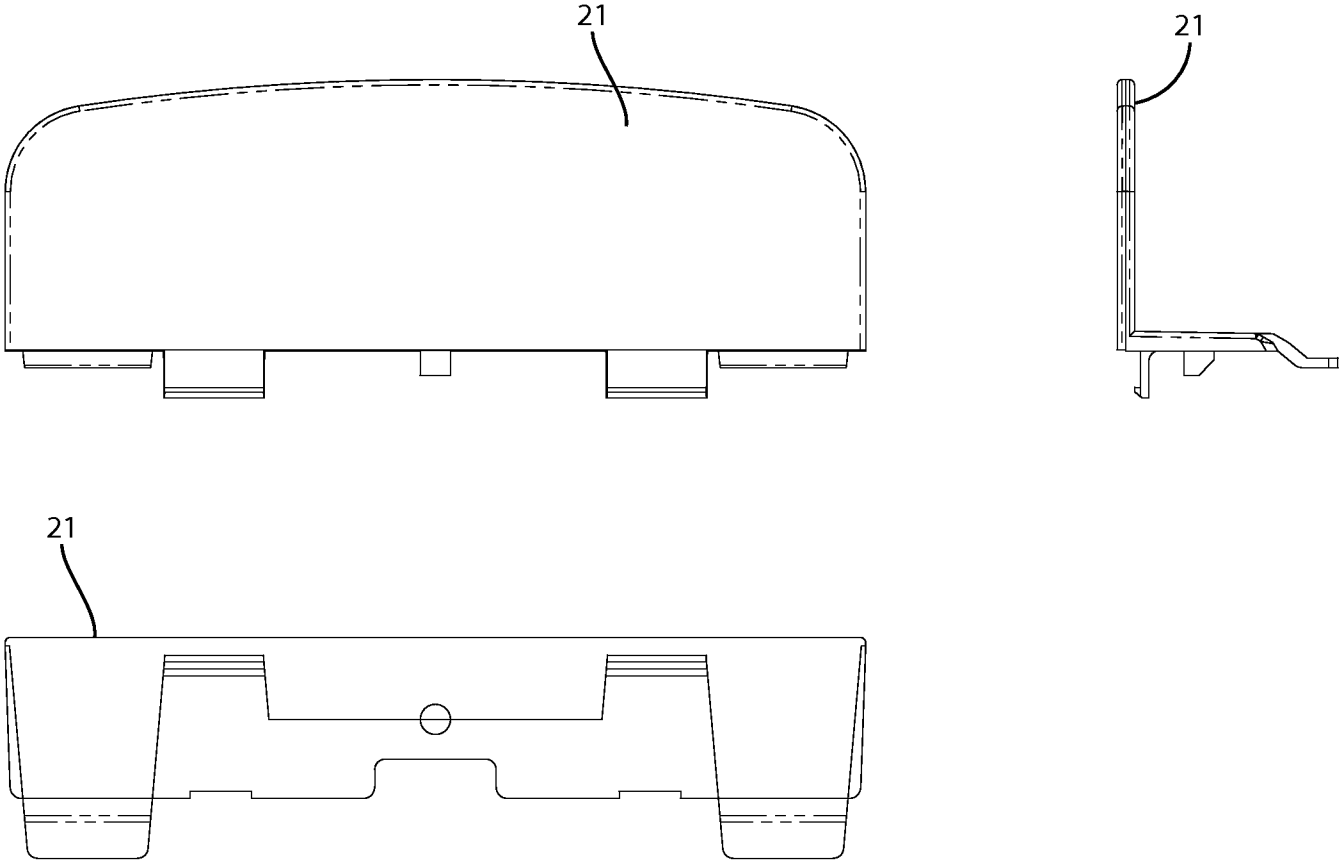
FIG. 14 is a front elevation view of a fence or end wall incorporated in the display tray assembly of FIGS. 1 and 2.

Referring back to FIGS. 1 and 2, the center tray section 20 further includes a fence 21 that prevents items from falling (or being pushed by the pusher 24) off the end of the freezer tray assembly 10. A number of views of an exemplary fence 21 are illustrated in FIG. 14.

Figure 11:
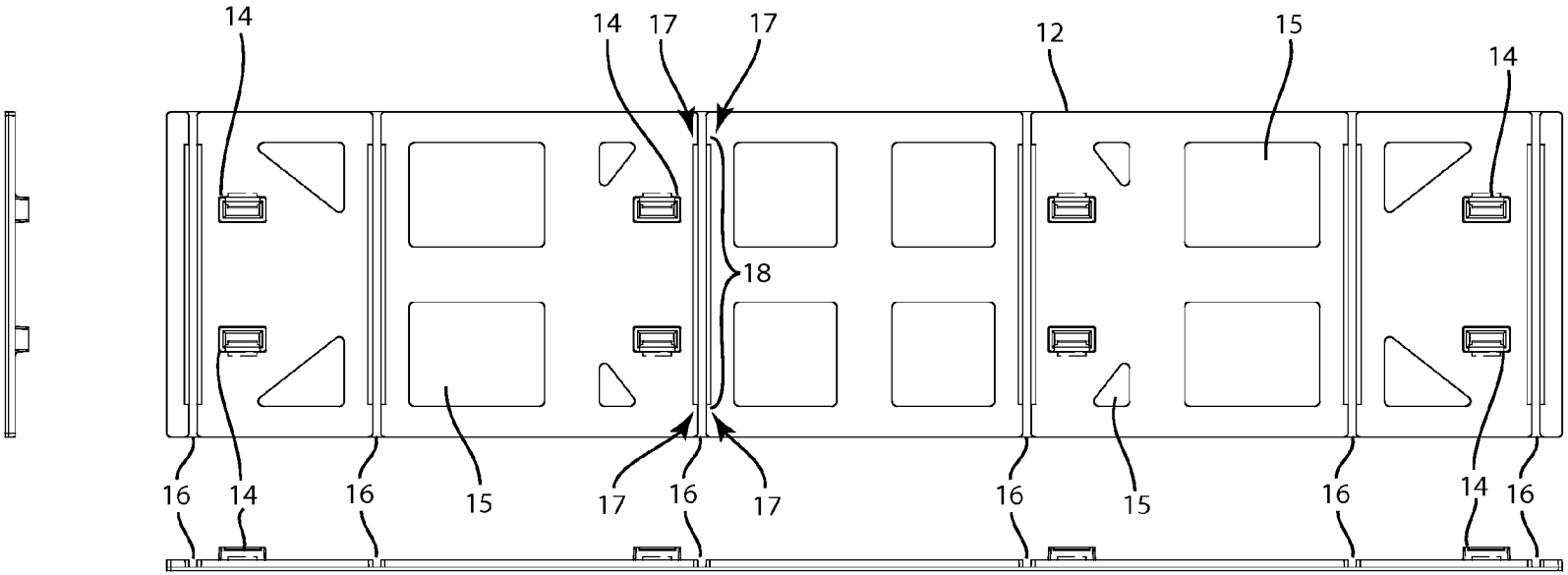
FIG. 11 is a top plan view of a base incorporated in the display tray assembly of FIGS. 1 and 2.

The center tray section 20 is secured to a base 12 to form a center tray assembly 11. The base 12 provides stability to the freezer tray assembly 10 and also functions support the freezer tray assembly 10 on a shelf or other supporting, structure within a freezer. The base 12 is shown in greater detail in top and side views depicted in FIG. 11. As shown in FIG. 11, the base 12 has a series of lugs 14 that define openings for receiving fasteners 13 (as shown in FIG. 6), e.g., snaps or the like, that secure the center tray section 20 to the base 12. The base 12 may be in the form of a rectangular plate that has a series of apertures 15. The apertures 15 are of such a shape and size so as to reduce the amount of material needed to manufacture the base 12 without compromising its structural integrity. When secured together to form the center tray assembly 11, the center tray section 20 and the base 12 form gaps within which side tray sections 30 or union tray sections 40 may be received.

The base 12 further includes a series of grooves 16. The grooves 16 generally extend across the width of the base 12. The grooves 16 further include shoulders 17 along the groove 16 at locations near the side edges of the base 12. The shoulders 17 define a widened section 18 of the groove 16. The widened section 18 continues the grooves 16 at a greater width than the groove 16 has at the edges of the base 12. In an embodiment, the depth of the widened section 18 may be different than that of the groove 16 itself. In an exemplary embodiment, the widened section is of a shallower depth than the groove 16.

Figure 7A:
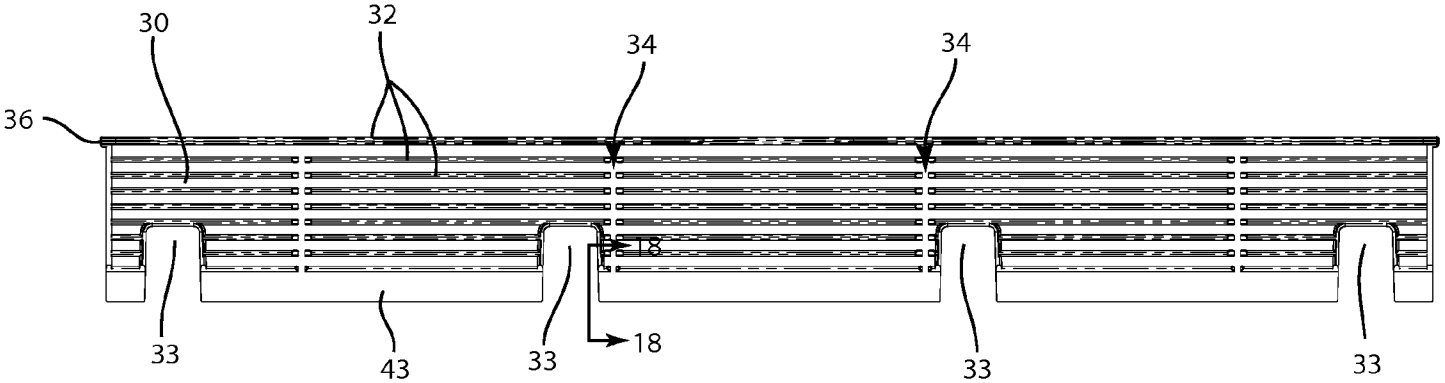
FIG. 7*a* is a top plan view of an embodiment of a side tray section incorporated in the display tray assembly of FIG. 1.

Two examples of side tray sections 30 are shown in FIGS. 7*a, b* and 8*a, b*. The embodiment illustrated in FIGS. 7*a* and 7*b* correspond to the first exemplary embodiment of FIG. 1, and the embodiment illustrated in FIGS. 5*a* and 5*b* correspond to the second exemplary embodiment of FIG. 2. It should be noted that in the illustrated configurations there are side tray sections 30 positioned on either side of the center tray sections 20. Thus, there may be right side tray sections 30 and left side tray sections 30. However, the preferred design is such that the side tray sections 30 may be used on either the left side or the right side of the center tray assembly i.e., there is no difference in design between left side trays 30 and right side trays 30. In this manner, the side tray sections 30 are modular and interchangeable components of the freezer tray assembly 10.

Figure 8A:
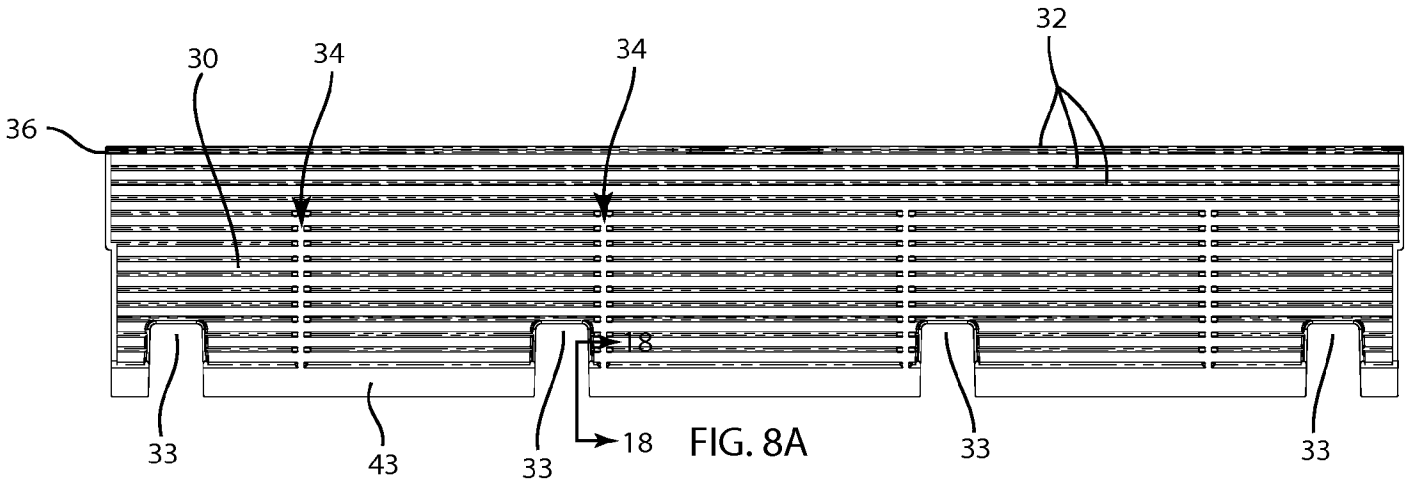
FIG. 8*b* is a side elevation view of the side tray section of FIG. 5*a;*

As shown in FIGS. 7*a* and 8*a*, side tray sections 30 are in the form of a rectangular plate, having a similar thickness and length as the center tray section 20. The side tray sections 20 have an elongated edge 35 that is configured to be received within a gap in the center tray assembly 11. The side tray sections 30 have raised ridges 32 that are of similar size, of similar orientation, and similarly spaced as the ridges 22 of the center tray section 20. Therefore, in an embodiment, a cross-section through the side tray section 30 appears the same or similar to that depicted in FIG. 15. The side tray section 30 further include notches 33 in the edge 35 of the side tray sections 30 that are continued to be received within the center tray assembly. The lugs 14 of base 12 are received within notches 33, and function to guide movement of the side tray sections 30 relative to the center tray section 20. Thus, when the side tray sections 30 are moved relative to the center tray section 20 and the base 12, the lugs 14 provide front-to-back alignment of the side tray sections 30, to prevent side tray sections 30 from skewing when the side tray sections 30 are moved inwardly and outwardly relative to center tray section 20.

Figure 7B:
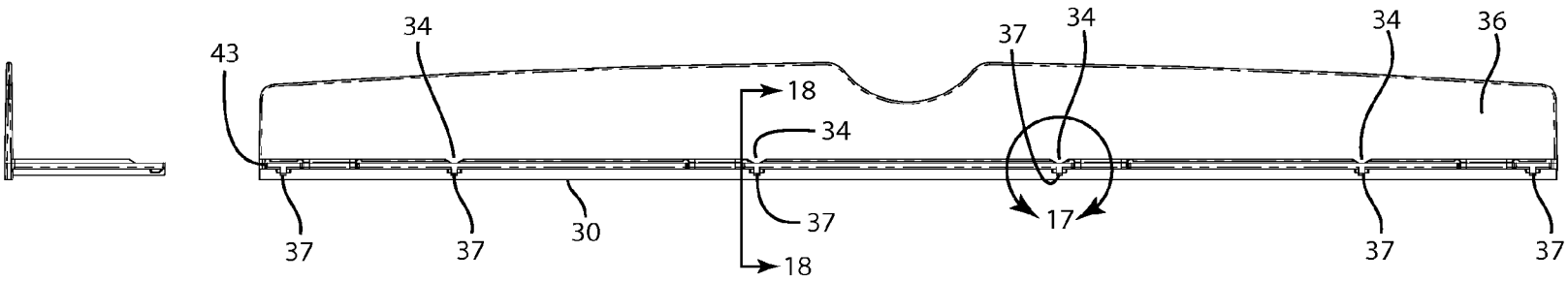
FIG. 7*b* is a side elevation view of the side tray section of FIG. 7*a;*
Figure 8B:
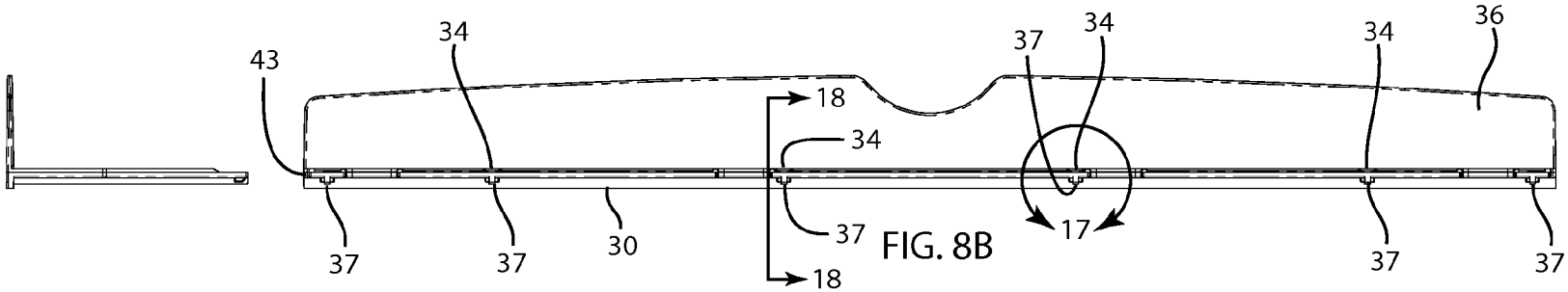
Figure 17:
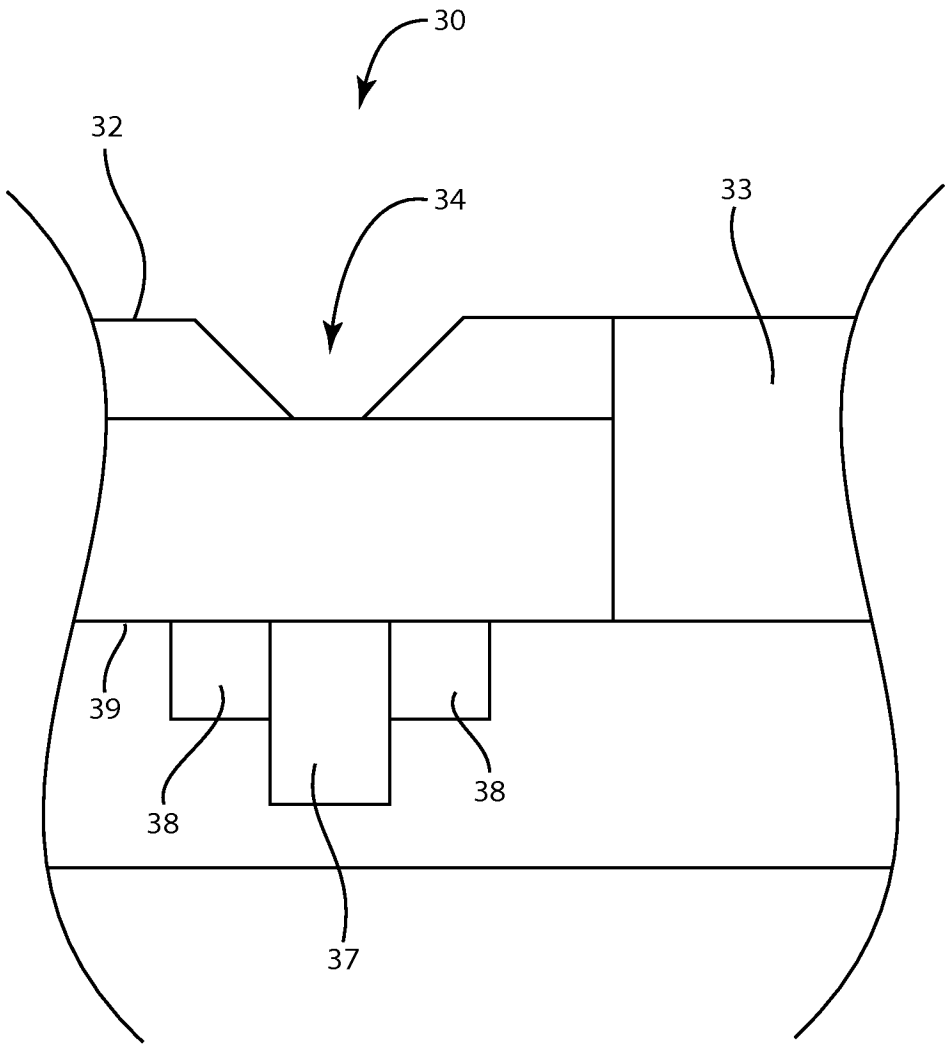
FIG. 17 is a close up of the section 17-17 of FIG. 7B.
Figure 18:
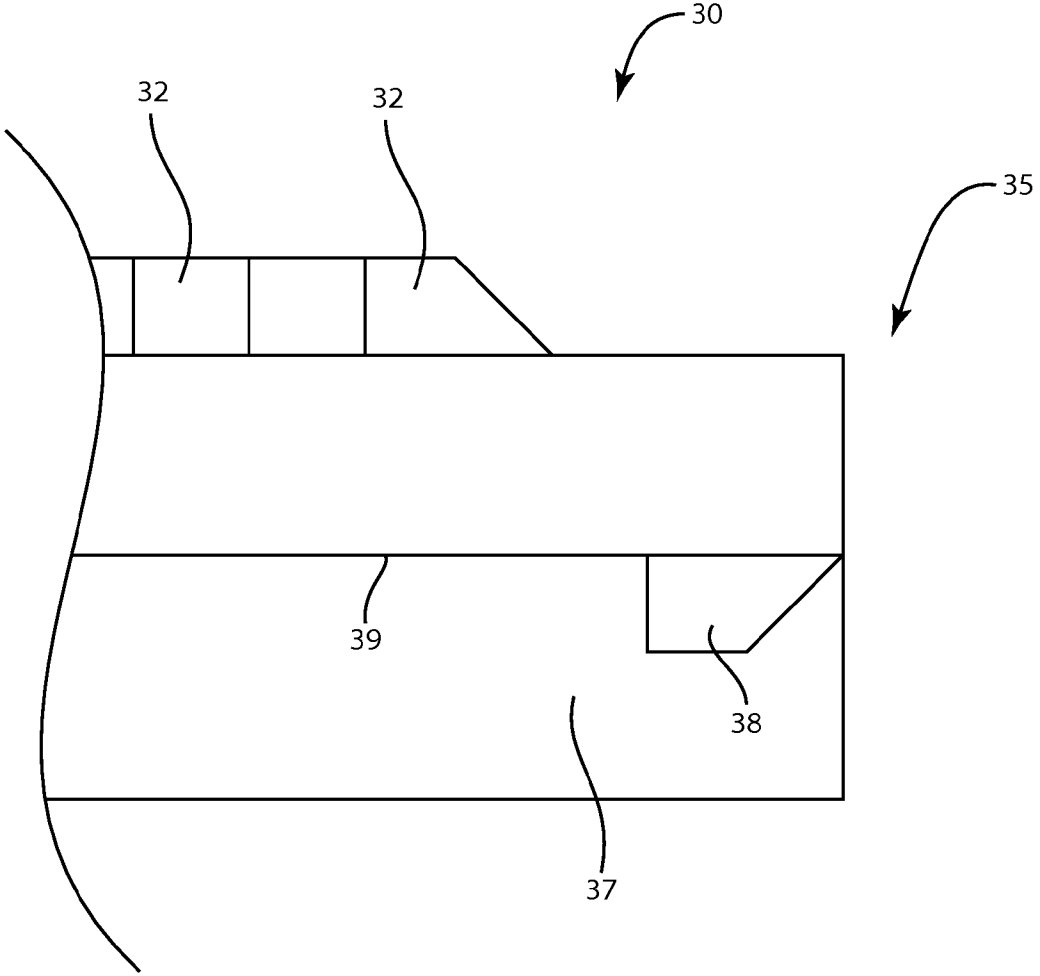
FIG. 18 is a partial sectional view taken along line 18-18 of FIG. 7B.

In the embodiments depicted in FIGS. 7*b* and 8*b*, an underside of the side tray section 30 further includes ribs 37 which are better depicted in FIG. 17 which is a close up view of the region denoted by lines 17-17 in FIG. 7*b* and FIG. 18 which is a partial sectional view of the side tray section 30 taken along line 18-18 of FIG. 7*b*. In an embodiment, the ribs 37 are aligned with the grooves 34 on the top surface of the side tray section 30. In an embodiment, the ribs 37 extend at a similar length across the width of the side tray section 30 as the grooves 34. The ribs 37 further include projections 38 that extend laterally from the sides of the rib 37. In an embodiment, the projections only extend along a portion of the rib 37. In still further embodiments, and as depicted in FIGS. 17 and 18, the projections 38 may be shorter in comparison to the rib 37, such that the rib 37 extends away from the bottom surface 39 of the side tray section 30 at a greater distance than the projections 38.

Still referring to FIGS. 7*a* and 8*a*, the ridges 32 of the side tray sections 30 have intermittent breaks or gaps that form a plurality of grooves 34. The grooves 34 correspond with guides 26 that extend beneath the center tray section 20, as further illustrated in FIG. 6. Thus, as the side tray sections 30 move relative to the center tray section 20, the guides 26 slide along the grooves 34 to guide the side tray sections 30 and to ensure that the side tray sections 30 move uniformly in a front-to-back direction so as to prevent the side tray sections 30 from skewing relative to the center tray section 20.

Referring further to FIG. 11, when the elongated edge 35 of a side tray section 30 or union tray section 40 is inserted into the gap between the base 12 and the center tray section of a center tray assembly, the ribs 37 of the side tray section 30 or union tray section 40 are received in the grooves 16 of the base 12. The groove 16, and particularly the portion of the groove 16 that does not include the widened section 18 maintain the side tray section 30 or union tray section 40 in alignment with the base 12 and center tray section of the center tray assembly. Additionally, the projections 38 move resiliently past the shoulder 17 of the groove 16 and seat or other engage within the widened section 18. While the engagement of the projections 38 in the widened section 18 further maintains the alignment of the center tray section 30 or union tray section 40 with the base 12 and center tray section 20 of the center tray assembly, the projections 38 further engage the shoulder 17 such as to retain the side tray section 30 or union tray section 40 in engagement with the base 12 and center tray section of the center tray assembly.

In these illustrated embodiments, the center tray section 20 has a plurality of clips 28 that secure the side tray section 30 at a discrete lateral position with respect to the center tray section 20. As shown in FIG. 5, each clip 28 is formed by slots in the center tray section 20 that extend perpendicular to a side edge of the center tray section 20. Each clip 28 has a downwardly extending lip 29 that normally resides in a first position. In operation, the downwardly extending lip 29 engages and secures the side tray section 30 by extending into a space between two adjacent ridges 32. When the side tray is moved as desired, the ridges 32 flex the lip 29 (and thus the clip 28) upwardly into a second position that allows the ridge 32 to pass beneath it. Once the lip 29 has moved over a ridge 32, the lip 29 returns to the first position and settles into the adjacent space. Thus, the side tray 30 is moved amongst a plurality of discrete positions that correspond with the spaces between the ridges 32.

In an embodiment as described above concerning, the interaction of the plurality of clips 28 and lips 29 as shown in FIG. 5 with the ridges 32 of the side tray sections and union tray sections, in an embodiment, the ridges 32 are configured in a manner as described above with respect to FIG. 15 and thus, the ridges 32 perform the dual and opposing functions of both reducing friction as applied between a product translating parallel along the ridges 32 and creating, points of engagement with the lips 29 of the clips 28 in order to impede movement of the side tray section or union tray section into and out of the gap formed between the base and the center tray section of the center tray assembly perpendicular to the ridges 32. The engagement of the lips 29 of the clips 28 help to regulate the position of the side tray section or union tray section relative to the center tray assembly by both defining incremental positions as well as facilitating that the side tray section or union tray section is held at the same incremental position along the length of the section.

In another embodiment, the side trays 30 are received within the space provided between the base 12 and the center tray section 20. The lugs 14 of the base 12 provide a spacing between the base 12 and the center tray section 20. This space is dimensioned to approximate the thickness of the side tray section 30 so that the side tray section 30 is sandwiched between the base 12 and the center tray section 20. The side tray section 30 is thus infinitely positionable laterally with respect to the center tray section 20 while the engagement of the lugs 14 of the base 12 with the notches 33 maintain alignment of the side tray section 30 and the center tray section 20 as described above.

The side tray section 30 preferably has a fence or side wall 36 that is vertically oriented and extends along a longitudinal axis of the side tray section 30. The side wall 36 helps to secure items on the freezer tray assembly 10, and to guide items as they are moved on the freezer tray assembly 10. The side wall 36 may be integral with side tray section 30, or it may be a separate, removable component.

In the embodiment shown in FIGS. 3*a* and 3*b*, the width of the side tray section 30 is about half the width of the center tray section 20. Thus, a freezer tray assembly 10 that includes a center tray section 20 and two side tray sections 30 has a wide range of adjustably in terms of surface area for storing items. In one embodiment, the width of the freezer tray assembly 10 can range from at the smallest (in the fully retracted position in FIG. 3*a*) the width of the center tray section 20 to at the largest (in the fully extended position in FIG. 3*b*) approaching twice the width of the center tray section 20. As discussed above, in one embodiment the overall width of the freezer tray assembly 10 can be varied along increments that correspond with the spaces between the ridges 32 of the side tray sections 30. Such an embodiment is illustrated in FIGS. 4*a* and 4*b*. It should be noted that an alternate system may be used to secure the side tray sections 30 within the assembly. In alternative embodiments, the clips 28 may be eliminated to allow for infinite adjustment in the width of the freezer assembly 10 (as opposed to the discrete number of widths when the clips 28 are utilized).

Figure 9A:
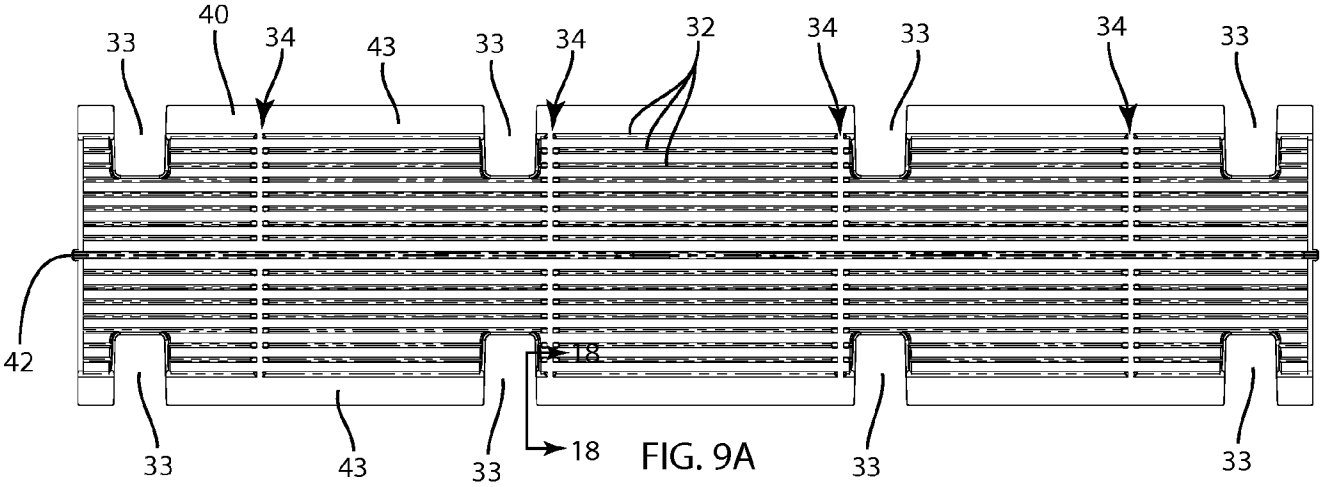
FIG. 9*a* is a top view of an embodiment of a union tray that may optionally be incorporated in the display tray assembly of FIG. 1.
Figure 9B:
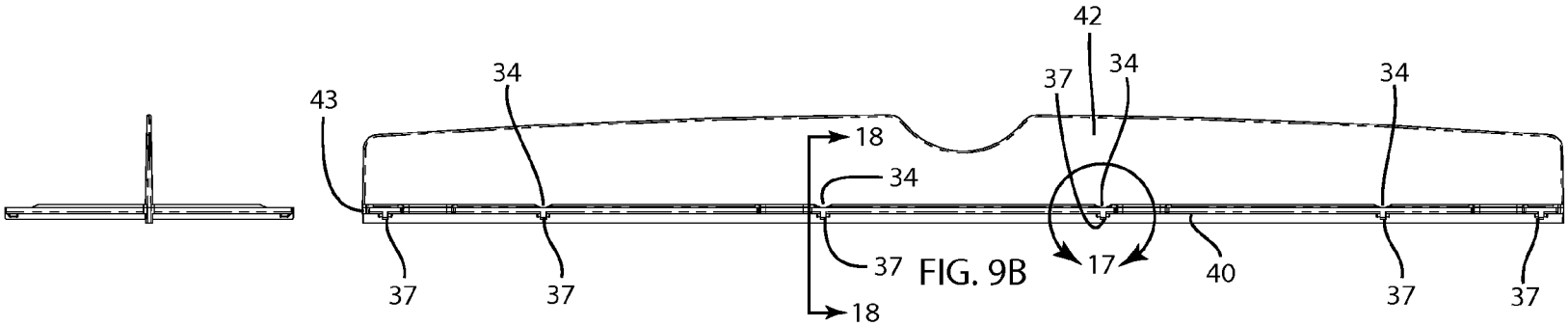
FIG. 9*b* is a side elevation view of the union tray of FIG. 9*a;*
Figure 10A:
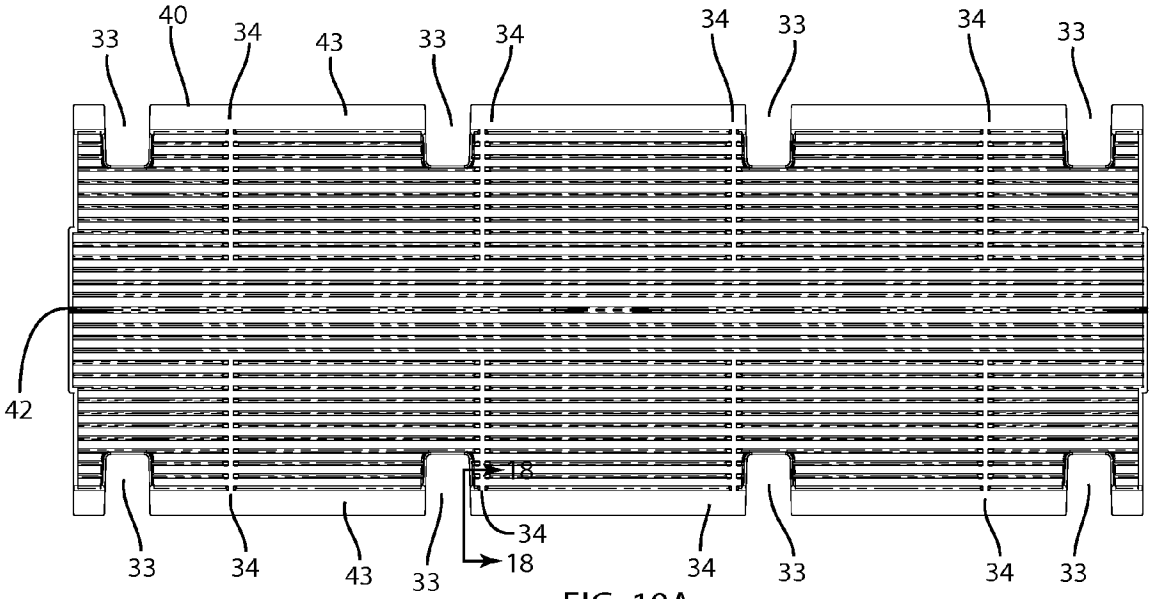
FIG. 10*a* is as top view of an embodiment of a union tray that may optionally be incorporated in the display tray assembly of FIG. 2.
Figure 10B:
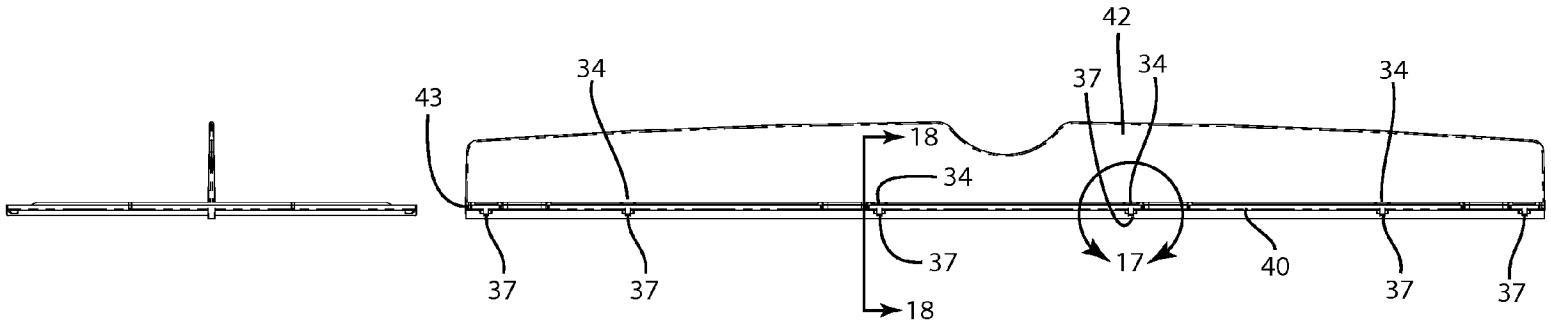
FIG. 10*b* is a side elevation view of the union tray of FIG. 10*a;*

In an alternative embodiment, a union tray section 40 may be used between two adjacent center tray sections 20, such as in the place of one or more adjacent side tray sections 30. As shown in FIGS. 9*a, b* and 10*a, b*, the union tray section 40 is similar in configuration to two side tray sections 30 that are joined along their respective inner edges, i.e., the edges that do not have notches 33. Due to the similarities between the side tray sections 30 and the union try sections 40, like reference numerals used with respect to components of the union tray sections 40 are used to identify the structures already as described above with respect to the side tray sections 30. The union tray section 40 has a center wall 42 that is used to form adjacent rows for storing items within the freezer. Thus, the union tray section 40 may slide laterally between the adjacent center trays 20 whereby the lateral motion of the center wall 42 caries the width of the adjacent rows. The center wall 42 of the union tray section 40 can thus be used with adjacent freezer tray assemblies 10, in order to provide a single divider wall between adjacent tray assemblies 10, thus eliminating a double wall thickness resulting from two adjacent tray assemblies placed side-by-side.

The freezer tray assembly 10 of the present invention may include any desired combination of center tray sections 20, side tray sections 30 and union tray sections 40. These components are modular and interchangeable so that a specific freezer tray assembly 10 may be assembled to accommodate a variety of freezers and products. The various components of the freezer tray assembly 10 may be made of any suitable material. Preferably the components of the freezer tray assembly 10 are made from injection molded high-density polyethylene (HDPE) and, although it is understood that any other satisfactory material may be employed.

The freezer tray assembly 10 of the present disclosure accomplishes a number of desirable objectives in the retail display of frozen products. By providing a solid floor, the freezer tray assembly 10 insures that items are reliably moved forwardly toward the front of the freezer when a forward most item is removed. This reduces door opening times, which can result in significant savings in energy costs. The adjustable side tray sections 30 allow the freezer tray assembly to have virtually any desired width, which can accommodate the vast majority of frozen products such as frozen vegetables, frozen potato produces and frozen entrées. Adjacent freezer tray assemblies 10 can be chained together using union tray sections 40, to effectively form a unitary tray structure that can extend any desired width within a freezer. This is particularly advantageous, in that the products supported by all of the interconnected freezer tray assemblies 10 function as ballast to prevent unwanted movement of the freezer tray assemblies within the freezer. The freezer tray assembly 10 is preferably formed of a material, such as HDPE, which is capable of withstanding low temperature environments such as are found in supermarket freezers, and the construction of the freezer tray assembly 10 is such that the various pieces and parts are capable of operating in such an environment. Typically, however, the knee 21 will be formed of a clear material to provide product visibility.

Referring again to FIGS. 1-4*b*, in further embodiments, the combination of particular features as disclosed herein can provide additional features. As described above, the center tray section 20, side tray sections 30, or union tray sections 40 can be specifically designed with a plurality of ridges 22 and valleys 27 that are designed and arranged as described above to reduce a coefficient sliding friction between the product and the surfaces. The further disclosed combinations of low friction materials can further reduce this friction while also giving the freezer tray assembly improved durability.

Figure 13:
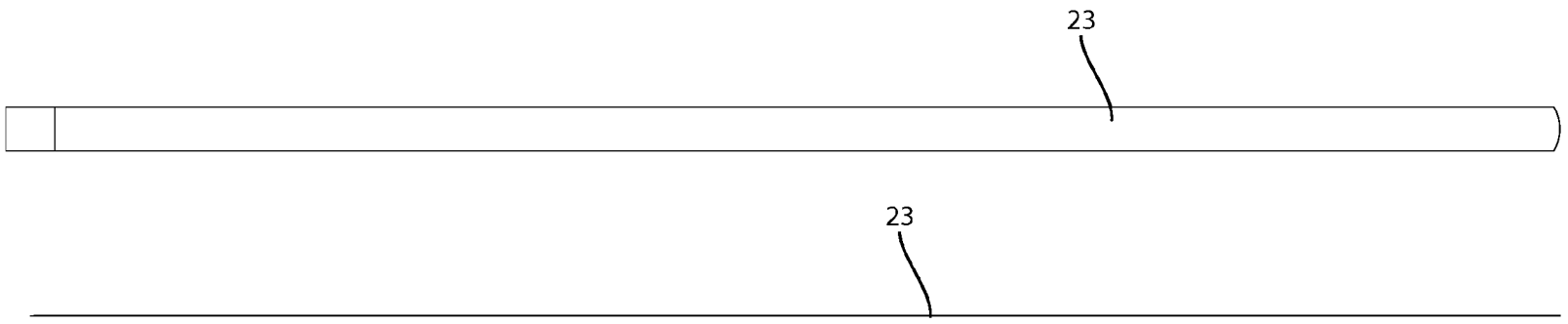
FIG. 13 is a top view of a bias element, in the form of a coil spring, incorporated in the display tray assembly of FIGS. 1 and 2 for biasing the pusher forwardly.

In an embodiment, such as that depicted in FIGS. 1 and 2, a pusher assembly 24 is used to progressively face the product by moving the product along the freezer tray assembly 10 and into contact with the fence 21. A coil spring 23 provides the force to achieve this automated facing. One such spring that may be used in embodiments is a variable force spring such as is available from Vulcan Spring and Mfg. Co. of Telford, Pa. An exemplary spring 23 is illustrated in FIG. 13. The design of variable force coil springs allow for the spring to provide varying degrees of force at different stages of extension along the freezer tray assembly 10. Thus, greater force can be achieved when the coil spring is fully extended, such as when the freezer tray assembly 10 is filled with product and this increased force can be translated through the pusher assembly 24 to the entirety of the containers placed within the freezer tray assembly to force all of the containers forward against the fence 21. However, when only one or a few containers remain within the freezer tray assembly 10, the variable force coil spring 23 is designed to apply a minimized force to keep the remaining container or containers faced within the freezer tray assembly 10.

In an embodiment of the freezer tray assembly 10 that combines the disclosed ridges 22 and valleys 27 for reduced friction with the variable force spring 23, the result is that a smaller spring with reduced variable forces at each stage of the variable force spring can be used. In some embodiments, a reduction of required force of 20% or more can be achieved with this combination of structural features. The reduction of the force required in the variable force spring may be achieved by adjusting, the gauge, girth, or the tightness of the coil in the coil spring.

The practical effect of this embodiment is an improved stocking and consumer experience when interacting with the freezer tray assembly embodiments. Reduced spring force improves the stocking experience as less force is required by store personnel to overcome the pusher assembly 24 in order to fill the freezer tray assembly with product. The consumer experience is also improved as the force applied by the variable force spring 23 can further be reduced such that the products are easily removed from the freezer tray assembly by the consumer. As the pusher assembly 24 places a compressive force upon the product between the pusher 24 and the fence 21, this applied force can make removal of product difficult for some consumers. Furthermore, when the last or one of the last of the products remaining in the freezer tray assembly 10 is removed by the consumer, some embodiments of freezer tray assembly can experience "snapping" wherein the coil spring 2 moves the pusher 24 into a forwardmost position, sometimes in contact with the fence 21. By minimizing the force applied to the pusher assembly 24, this experience can be minimized or eliminated.

Figure 16:
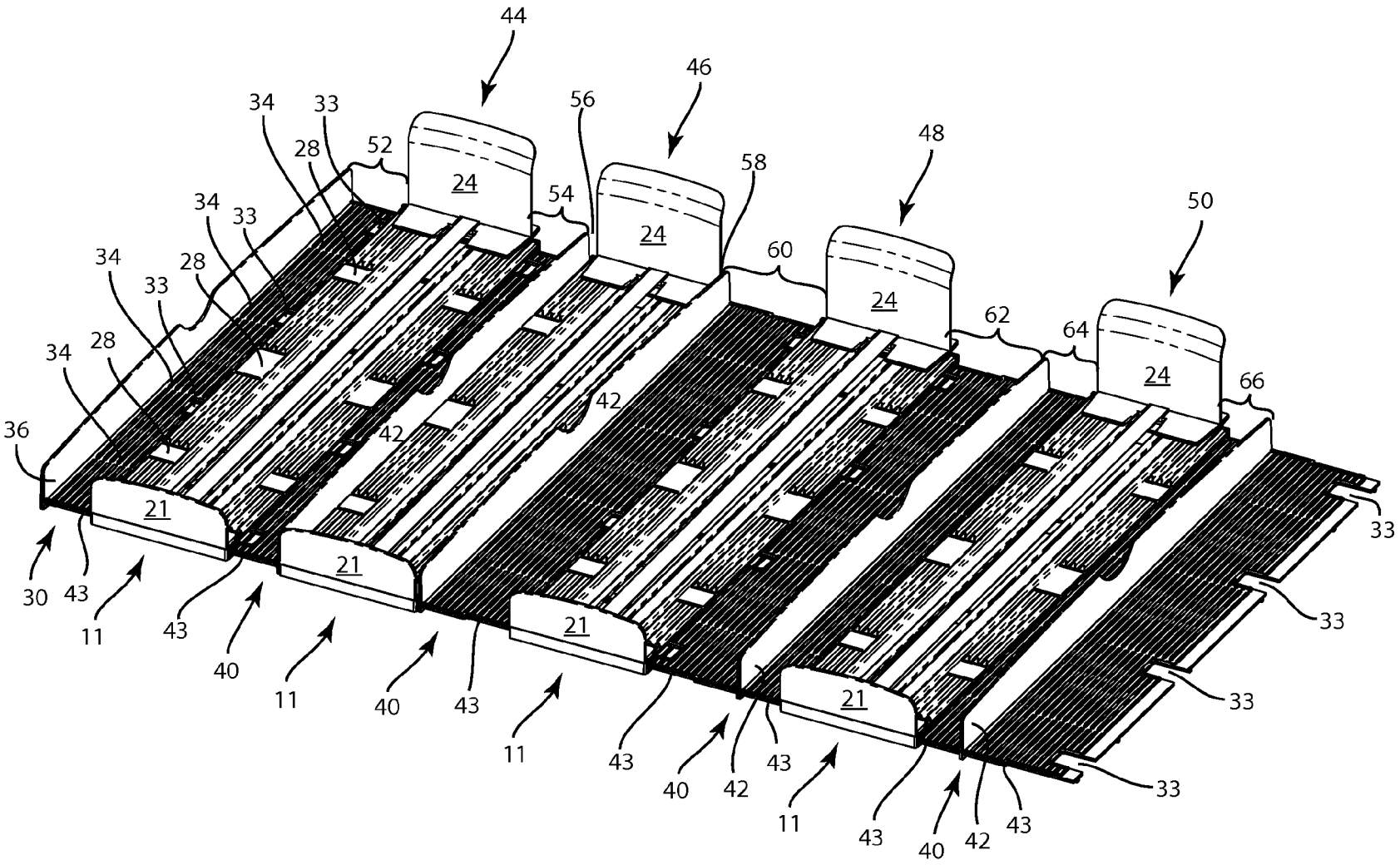
FIG. 16 is an isometric view of an exemplary embodiment of a display tray system.

FIG. 16 depicts an exemplary embodiment of a display tray system that includes a plurality of display tray assemblies 44-50. Embodiments of the display tray assemblies as disclosed herein confirm additional distinct advantages when combined together in a series of display tray assemblies to form a display tray system. It will be noted that in FIG. 16, many reference numerals as used and described above are also found in FIG. 16 and it is to be understood that the descriptions of those reference numerals found above similarly apply to the exemplary embodiment of the display tray system as depicted in FIG. 16.

It will be noted that the display tray assembly 44 is defined between a side tray section 30 and a union tray section 40. More specifically, the display tray assembly 44 is configured to receive product at a width defined between the side walls 36 of the side tray section 30 and the center wall 42 of the union tray section 40. Therefore, the width of the display tray assembly 44 can be defined as the width of the center tray assembly 11 plus distance 52 between an edge of the center tray assembly 11 and the side wall 36 and a distance 54 between the edge of the center tray assembly 11 and the center wall 42.

It is will be noted that each of the display tray assemblies 44-50 represent varying widths to which the display tray assemblies may be adjusted. Exemplarily, display tray 46 represents a display tray assembly configured at a narrow width wherein the center walls 42 of the union tray sections 40 on either side of the center tray assembly 11 of the display tray assembly 46 are located as far into the center tray assembly 11 and therefore distances 56 and 58 are minimal. To the contrary, display tray assembly 48 is configured at a maximum width wherein the distances 60 and 62 between the center tray assembly 11 and the respective center walls 42 of the union tray sections 40 adjacent to the center tray assembly 11 are maximized. In reference to the disclosure above, in such a maximized configuration, projections 38 of the rib 37 may be engaging the shoulder 17 of the groove 16 in the base 12. Display tray assembly 50 represents an intermediate configuration showing other exemplary distances 64 and 66.

It will be noted, that one advantage of the display tray system depicted in FIG. 16 is that despite the connection of each of the display tray assemblies due to adjacent display tray assemblies using a common union tray section 40, the widths of each of the display tray assemblies 44-50 are independently adjustable as the adjustment of the width of each individual display tray assembly is facilitated by inserting or withdrawing portions of the respective side tray section 30 or union tray section 40 into the center tray assembly 11. This is particularly advantageous in the retail setting when a retailer wishes to change product placement, requiring a display tray assembly of a different width in the depicted display tray system, the retailer need not adjust the widths of all of the display tray assemblies in the system in order to change the width of one of the assemblies. To provide a contrasting example, in currently available systems that define product facings with walls that slide along front and back infinitely adjustable rails, since adjacent product facing spaces share a single divider wall, movement of that wall along the infinitely adjustable rail necessarily changes the width of the adjacent product facing space. Thus, the display tray system as disclosed herein provides a significant advantage over a previous product display system.

In a still further exemplary embodiment, in retail applications, a retailer may have a category cut in or category reset in which a shelving planogram is rearranged such that the locations of an exemplary five inch product facing and an exemplary 10 inch product facing are to be swapped from generally opposite ends of a shelf. To place this example in context, exemplarily, the retailer may desire to change the width of display tray assembly 44 from five inches to 10 inches while reducing, the width of display tray assembly 50 from 10 inches to five inches. Under currently available systems, the walls that form each intermediate product facing (e.g. display tray assemblies 46 and 48) must be slid in the direction of the product facing to be narrowed. As noted above, this movement changes the widths of adjacent product facings, which effectively requires individually adjusting the size of each product facing in the system. This not only requires the time and effort to move the product facings, but thither requires movement of any UPC tags associated with the intermediate product facings. This movement of the product facings would create the additional space in order to provide the ten inch product facing at the new location.

In the display tray system depicted in FIG. 16 however, the new product facings can be adjusted in the following manner, the product from the display tray assembly 44 which is currently configured at a 10 inch width is removed and replaced with the new five inch product facing that was previously located at display tray assembly 50. The person adjusting the product facings then applies a force to the union tray section 40 adjacent to the display tray to be enlarged (e.g. assembly 50) in the direction of display tray assembly to be reduced assembly 44). As current product facings in display tray assemblies 46 and 48 maintain the widths of those display tray assemblies, the side tray assembly 30 and union tray assembly 40 adjacent the display tray assembly 44 retract into the gap between the center tray section 20 and base 12 of the display tray assembly 44 to reduce the width of that display tray assembly to the new five inch size of the new product facing. This applied force on the union tray section 40 adjacent the display tray assembly 50 also increases the width of the display tray assembly 50 which is now ready to receive the new ten inch product facing. In embodiments, wherein the UPC or other product identification tag are placed on the fences 21, these tags have also moved in connection with display tray assemblies 46 and 48 and no further action is required in moving the product facings in those display tray assemblies.

This written description uses examples to disclose the invention, including the best mode, and also to enable any person skilled in the art to make anew the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A display tray system, comprising:

a union tray section comprising a center wall and first and second trays extending away from the center wall;

a first center tray assembly having a first center tray section secured to a first base and defining a first gap therebetween, the first tray movably secured within the first gap;

a side tray section comprising a side wall and a side tray extending away from the side wall, wherein the side tray is movably secured within the first gap;

a first product support area defined by at least the first center tray section, the side tray, and the first tray;

a second center tray assembly having a second center tray section secured to a second base and defining a second gap therebetween, the second tray movably secured within the second gap; and a second product support area defined by at least the second center tray section and the second tray;

wherein the first center tray assembly and second center tray assembly are independently movable with respect to the center wall such that a width of the first product support area is changeable while maintaining a width of the second product support area.

2. A display tray system, comprising:

a union tray section comprising a center wall and first and second trays extending away from the center wall;

a first center tray assembly having a first center tray section secured to a first base and defining a first gap therebetween, the first tray movably secured within the first gap;

a first product support area defined by at least the first center tray section and the first tray;

a second center tray assembly having a second center tray section secured to a second base and defining a second gap therebetween, the second tray movably secured within the second gap; and a second product support area defined by at least the second center tray section and the second tray;

wherein the first and second trays comprise a plurality of ridges parallel to the center wall and the first and second center tray sections comprise a plurality of clips each comprising a lip configured to resiliently engage at least one ridge of the plurality of ridges to movably secure the first and second trays within the first and second gaps.

3. The display tray system of claim 2, further comprising:

a plurality of ridges located on the first center tray section and the second center tray section;

wherein each of the plurality of ridges on the first and second center tray sections and the plurality of ridges of the first and second trays are convex in a cross-sectional shape.

4. The display tray system of claim 2 further wherein the plurality of ridges define a plurality of incremental widths for the first product support area and the second product support area.

5. The display tray system of claim 2, further comprising:

a plurality of ribs projecting; from a bottom surface of the first and second trays, the plurality of ribs perpendicular to the center wall;

a plurality of grooves formed in the base;

wherein the plurality of ribs of the first and second trays slidably engage respective grooves of the plurality of grooves formed in the base.

6. The display tray system of claim 5, further comprising:

a plurality of grooves transecting and perpendicular to the plurality of ridges in the first and second trays;

a plurality of guides projecting from the first and second center tray sections into the first and second gaps;

wherein the plurality of guides of the first and second center tray sections slidably engage respective grooves of the plurality of grooves in the first and second trays.

7. The display tray system of claim 6, further comprising:

a plurality of lugs that respectively secure the first and second center tray sections to the first and second bases;

a plurality of notches formed through the first and second trays, the plurality of notches configured to respectively align with and slidably receive a lug of the plurality of lugs as the first and second trays move within the first and second gaps;

wherein the plurality of ribs projecting from the bottom surface of the first and second trays, the plurality of grooves formed in the base, the plurality of grooves transecting the plurality of ridges in the first and second trays, the plurality of guides projecting, from the first and second center tray sections, the plurality of lugs, and the plurality of notches operate to maintain a parallel relationship between the center wall, the first center tray assembly, and the second center tray assembly.

8. The display tray system of claim 5, further comprising:

at least one shoulder at opposing ends of each of the plurality of grooves formed in the base; and at least one projection extending away from each of the plurality of ribs projecting from the bottom surface of the first and second trays, wherein the at least one shoulder resiliently engages the at least one projection to maintain the first and second trays movably secured within the first and second gaps.

9. A display tray system, comprising:

first, second, and third center tray assemblies, each center tray assembly comprising a center tray section, a plurality of ridges on a top surface of the center tray section, and a base secured to a bottom side of the center tray section defining a gap between the center tray section and the base;

a side tray section having a side wall secured to a side tray, the side tray movably received and secured within the gap of the first center tray assembly;

a first union tray section having a first center wall secured to first and second trays, the first tray movably received and secured within the gap of the first center tray assembly and the second tray movably received and secured within the gap of the second center tray assembly;

a second union tray section having a second center wall secured to third and fourth trays, the third tray movably received and secured within the gap of the second center tray assembly and the fourth tray movably received and secured within the gap of the third center tray assembly;

a first product support area defined between the side wall, first center tray assembly, and the first center wall;

a second product support area defined between the first center wall, second center tray assembly, and the second center wall; and a third product support area defined between at least the second center wall and third center tray assembly;

wherein a width of the first product support area is adjustable by moving at least one of the side tray and the first tray within the gap of the first center tray assembly, a width of the second product support area is adjustable by moving at least one of the second tray and the third tray within the gap of the second center tray assembly, and a width of the third product support area is adjustable by moving the fourth tray within the gap of the third center tray assembly.

10. The display tray system of claim 9, wherein the widths of the first, second, and third product support areas are independently adjustable.

11. The display tray system of claim 10, wherein the width of the second product support area is adjustable while maintaining the respective widths of the first product support area and the third product support area.

12. The display tray system of claim 10, further comprising:

a plurality of ridges on each of the side tray, first tray, second tray, third tray, and fourth tray;

a plurality of clips formed in the center tray sections of each of the first, second, and third center tray assemblies, each of the clips comprising a lip that extends from the clip into the respective gap of the first, second, and third center tray assemblies.

13. The display tray system of claim 12, wherein the plurality of ridges respectively define a plurality of incremental widths for the first product support area, second product support area, and third product support area.

14. The display tray system of claim 13, further comprising:

a plurality of ribs projecting from a bottom surface of each of the side tray, first tray, second tray, third tray, and fourth tray;

a plurality of grooves formed in each base of the first, second, and third center tray assembly;

wherein the plurality of ribs of the side tray and first tray engage the plurality of grooves of the base of the first center tray assembly, the plurality of ribs of the second tray and third tray engage the plurality of grooves of the base of the second center tray assembly, and the plurality of ribs of the fourth tray engage the grooves of the base of the third center tray assembly.

15. The display tray system of claim 14, further comprising:

a plurality of guides projecting from the bottom side of each of the center tray sections into the gaps of the first, second, and third center tray assemblies;

a plurality of grooves transecting and perpendicular to the plurality of ridges on each of the side tray, first tray, second tray, third tray, and fourth tray;

wherein the plurality of guides of the first center tray assembly engage the plurality of grooves of the side tray and first tray, the plurality of guides of the second center tray assembly engage the plurality of grooves of the second tray and third tray, and the plurality of guides of the third center tray assembly engage the plurality of grooves of the fourth tray.

16. The display tray system of claim 15, wherein the plurality of guides projecting from the bottom side of each of the center tray sections and the plurality of grooves in the base of each of the center tray sections are vertically aligned and the plurality of ribs and the plurality of grooves of each of the side tray, first tray, second tray, third tray, and fourth tray are vertically aligned.

17. The display tray system of claim 14, further comprising:

at least one shoulder at opposing ends of each of the plurality of grooves formed in the bases of each of the first, second, and third center tray assemblies;

at least one projection extending away from each of the plurality of ribs of the side tray, first tray, second tray, third tray, and fourth tray;

wherein the at least one shoulder of each of the plurality of grooves of the base of the first center tray assembly resiliently engages the at least one projection extending away from each of the plurality of ribs of the side tray and the first tray to maintain the side tray and first tray movably secured within the gap of the first center tray assembly;

wherein the at least one shoulder of each of the plurality of grooves of the base of the second center tray assembly resiliently engages the at least one projection extending away from each of the plurality of ribs of the second tray and the third tray to maintain the second tray and third tray movably secured within the gap of the second center tray assembly; and wherein the at least one shoulder of each of the plurality of grooves of the base of the third center tray assembly resiliently engages the at least one projection extending away from each of the plurality of ribs of the fourth tray to maintain the fourth tray movably secured within the gap of the third center tray assembly.

* * * * *